US011428072B2

(12) United States Patent
Rong et al.

(10) Patent No.: US 11,428,072 B2
(45) Date of Patent: Aug. 30, 2022

(54) ADAPTIVE FLUID SWITCHES FOR AUTONOMOUS FLOW CONTROL

(71) Applicant: Floway, Inc., Plano, TX (US)

(72) Inventors: Xinqi Rong, Dallas, TX (US); Liang Zhao, Allen, TX (US)

(73) Assignee: Floway, Inc., Plano, TX (US)

( * ) Notice: Subject to any disclaimer, the term of this patent is extended or adjusted under 35 U.S.C. 154(b) by 256 days.

(21) Appl. No.: 16/900,895

(22) Filed: Jun. 13, 2020

(65) Prior Publication Data

US 2020/0308931 A1 Oct. 1, 2020

Related U.S. Application Data

(63) Continuation-in-part of application No. 16/520,596, filed on Jul. 24, 2019, now Pat. No. 10,711,569, (Continued)

(51) Int. Cl.
*E21B 34/08* (2006.01)
*E21B 43/08* (2006.01)
(Continued)

(52) U.S. Cl.
CPC ..... *E21B 34/08* (2013.01); *E21B 43/08* (2013.01); *E21B 43/12* (2013.01); *E21B 49/08* (2013.01);
(Continued)

(58) Field of Classification Search
CPC .... E21B 49/08; E21B 49/087; E21B 49/0875; E21B 2049/08; E21B 47/06; E21B 43/12; E21B 34/08; E21B 43/08; E21B 43/086; E21B 2200/02; G05D 7/01; G05D 7/0113; G05D 7/014; G05D 7/0153; G05D 7/0146; G05D 7/00; F16K 31/122
See application file for complete search history.

(56) References Cited

U.S. PATENT DOCUMENTS 8,191,627 B2 6/2012 Hamid et al.
8,291,976 B2 10/2012 Schultz et al.
(Continued)

OTHER PUBLICATIONS

Miersma, Matthew; Analysis of Inflow Control Devices for Steam Assisted Gravity Drainage Using Computational Fluid Dynamics; Department of Mechanical Engineering—University of Alberta; 2018.

*Primary Examiner* — George S Gray
(74) *Attorney, Agent, or Firm* — Lawrence Youst PLLC

(57) ABSTRACT

An adaptive fluid switch for regulating the production rate of a fluid. The adaptive fluid switch includes a fluid control module having a fluid selector, a swirl chamber and a self-impinging valve element. When the fluid produced through the adaptive fluid switch has a viscosity greater than a first predetermined level, the fluid selector determines the fluid to be a selected fluid such that the fluid swirls in one direction in the swirl chamber and follows a low resistance flow path in the valve element. When the fluid has a viscosity less than a second predetermined level, the fluid selector determines the fluid to be a non-selected fluid such that the fluid swirls in the opposite direction in the swirl chamber and follows a high resistance flow path in the valve element, thereby regulating the production rate of the fluid responsive to changes in the viscosity of the fluid.

19 Claims, 15 Drawing Sheets

Related U.S. Application Data which is a continuation-in-part of application No. 16/206,512, filed on Nov. 30, 2018, now Pat. No. 10,364,646, which is a continuation of application No. 16/048,328, filed on Jul. 29, 2018, now Pat. No. 10,174,588, which is a continuation of application No. 15/855,747, filed on Dec. 27, 2017, now Pat. No. 10,060,221.

(51) Int. Cl.
*E21B 49/08* (2006.01)
*E21B 43/12* (2006.01)

(52) U.S. Cl.
CPC ..... *E21B 49/0875* (2020.05); *E21B 2200/02* (2020.05)

(56) References Cited

U.S. PATENT DOCUMENTS 8,602,106 B2 12/2013 Lopez
8,622,136 B2 1/2014 Dykstra et al.
8,931,566 B2 1/2015 Dykstra et al.
9,109,423 B2 8/2015 Dykstra et al.
9,249,649 B2 2/2016 Fripp et al.
9,394,759 B2 7/2016 Fripp et al.
9,404,349 B2 8/2016 Zhao
10,060,221 B1 8/2018 Rong et al.
10,174,588 B1 1/2019 Rong et al.
10,364,646 B2 7/2019 Rong et al.
2009/0145609 A1* 6/2009 Holmes ..... E21B 43/12 166/332.1
2011/0139453 A1 6/2011 Schultz et al.
2012/0152527 A1* 6/2012 Dykstra ..... E21B 28/00 166/316
2012/0255740 A1 10/2012 Fripp et al.
2013/0092393 A1 4/2013 Dykstra et al.
2015/0021019 A1* 1/2015 Veit ..... E21B 43/08 166/250.15
2015/0060084 A1* 3/2015 Moen ..... E21B 43/08 166/321
2016/0061373 A1* 3/2016 Russell ..... E21B 43/12 138/40
2017/0044868 A1 2/2017 Petegem et al.
2019/0345793 A1 11/2019 Rong et al.

* cited by examiner

ADAPTIVE FLUID SWITCHES FOR AUTONOMOUS FLOW CONTROL

CROSS-REFERENCE TO RELATED APPLICATIONS

The present application is a continuation-in-part of co-pending application Ser. No. 16/520,596 filed Jul. 24, 2019, which is a continuation-in-part of application Ser. No. 16/206,512 filed Nov. 30, 2018, now U.S. Pat. No. 10,364,646, which is a continuation of application Ser. No. 16/048,328 filed Jul. 29, 2018, now U.S. Pat. No. 10,174,588, which is a continuation of application Ser. No. 15/855,747 filed Dec. 27, 2017, now U.S. Pat. No. 10,060,221, the entire contents of each is hereby incorporated by reference.

TECHNICAL FIELD OF THE DISCLOSURE

The present disclosure relates, in general, to equipment used in conjunction with operations performed in hydrocarbon bearing subterranean wells and, in particular, to adaptive fluid switches configured to interpret fluid properties and select between high resistance and low resistance flow paths to autonomously transition between high flowrate and low flowrate regimes.

BACKGROUND

During the completion of a well that traverses a hydrocarbon bearing subterranean formation, production tubing and various completion equipment are installed in the well to enable safe and efficient production of the formation fluids. In some wells, to control the flowrate of production fluids into the production tubing, a fluid flow control system is installed within the tubing string that may include one or more inflow control devices such as flow tubes, nozzles, labyrinths or other tortuous path devices. Typically, the production flowrate through these inflow control devices is fixed prior to installation based upon the design thereof. It has been found, however, that production fluids are commonly multiphase fluids including oil, natural gas, water and/or other fractional components. In addition, it has been found, that the proportions of the various fluid components may change over time. For example, in an oil-producing well, the proportion of an undesired fluid such as natural gas or water may increase as the well matures.

As the proportions of the fluid components change, various properties of the production fluid may also change. For example, when the production fluid has a high proportion of oil relative to natural gas or water, the viscosity of the production fluid is higher than when the production fluid has a high proportion of natural gas or water relative to oil. Attempts have been made to reduce or prevent the production of undesired fluids in favor of desired fluids through the use of autonomous inflow control devices that interventionlessly respond to changing fluid properties downhole. Certain autonomous inflow control devices include one or more valve elements that are fully open responsive to the flow of a desired fluid, such as oil, but restrict production responsive to the flow of an undesired fluid, such as natural gas or water. It has been found, however, that systems incorporating current autonomous inflow control technology suffer from a variety of limitations such as fatigue failure of biasing devices, failure of intricate components or complex structures and/or lack of sensitivity to minor fluid property differences.

Accordingly, a need has arisen for a downhole fluid flow control system that is operable to control the inflow of production fluid as the proportions of the fluid components change over time without the requirement for well intervention. A need has also arisen for such a downhole fluid flow control system that does not require the use of biasing devices, intricate components or complex structures. In addition, a need has arisen for such a downhole fluid flow control system that has the sensitivity to operate responsive to minor fluid property differences.

SUMMARY

In a first aspect, the present disclosure is directed to an adaptive fluid switch for regulating the production rate of a fluid being produced from a hydrocarbon bearing subterranean formation. The adaptive fluid switch includes a fluid control module configured to interpret the viscosity of the fluid and determine whether the fluid is a selected fluid, such as oil, or a non-selected fluid, such as natural gas or water. A self-impinging valve element is disposed within the fluid control module. The valve element has a viscosity dominated flow path configured to provide a first flow resistance and an inertia dominated flow path configured to provide a second flow resistance that is greater than the first flow resistance. When the viscosity of the fluid is greater than a first predetermined level, the fluid control module interprets the fluid to be the selected fluid such that the fluid follows the viscosity dominated flow path with the lower flow resistance. When the viscosity of the fluid is less than a second predetermined level, the fluid control module interprets the fluid to be the non-selected fluid such that the fluid follows the inertia dominated flow path with the higher flow resistance, thereby regulating the production rate of the fluid responsive to changes in the viscosity of the fluid.

In some embodiments, the fluid may be a multiphase fluid containing at least an oil component and a water component such that the selected fluid has a predetermined fraction of the oil component and the non-selected fluid has a predetermined fraction of the water component. In certain embodiments, the fluid may be a multiphase fluid containing at least an oil component and a natural gas component such that the selected fluid has a predetermined fraction of the oil component and the non-selected fluid has a predetermined fraction of the natural gas component. In some embodiments, the fluid control module may be configured to interpret the viscosity of the fluid as an effective viscosity of a single phase fluid. In certain embodiments, the first predetermined level may be between 1 centipoise and 10 centipoises and the second predetermined level may be between 0.1 centipoises and 1 centipoise. In some embodiments, the first predetermined level may have a ratio to the second predetermined level of between 2 to 1 and 10 to 1.

In certain embodiments, the valve element may be a multistage self-impinging valve element such as a multistage self-impinging valve element having a plurality of parallel branches. In some embodiments, the valve element may be a ring valve element having multiple inlets and multiple outlets such as a tesla ring valve element. In certain embodiments, the valve element may be a bow valve element. In some embodiments, the valve element may be a cross valve element. In certain embodiments, a swirl chamber may be disposed within the fluid control module such that the swirl chamber may induce the selected fluid to swirl in a first direction and induce the non-selected fluid to swirl in a second direction that is opposite of the first direction. In some embodiments, the viscosity dominated flow path may be a high flowrate path and the inertia dominated flow path may be a low flowrate path. In certain embodiments, the valve element may have at least one impinging flow path and at least one compliant flow path. In such embodiments, at least one viscosity dependent resistor may be disposed within the impinging flow path, at least one inertia dependent resistor may be disposed within the compliant flow path or both.

In a second aspect, the present disclosure is directed to an adaptive fluid switch for regulating the production rate of a fluid being produced from a hydrocarbon bearing subterranean formation. The adaptive fluid switch includes a fluid control module having at least one inlet and at least one outlet. A fluid selector is disposed within the fluid control module. The fluid selector is configured to interpret the viscosity of the fluid and determine whether the fluid is a selected fluid or a non-selected fluid. A swirl chamber is disposed within the fluid control module downstream of the fluid selector. The swirl chamber is configured to induce the selected fluid to swirl in a first direction and induce the non-selected fluid to swirl in a second direction that is opposite of the first direction. A self-impinging valve element is disposed within the fluid control module. The valve element has multiple valve inlets, at least one valve outlet and a plurality of parallel branches. The valve inlets are in fluid communication with the swirl chamber. The at least one valve outlet is in fluid communication with the at least one outlet of the fluid control module. The valve element is configured to provide a first flow path with a first flow resistance and a second flow path with a second flow resistance that is greater than the first flow resistance. When the viscosity of the fluid is greater than a first predetermined level, the fluid selector determines the fluid to be the selected fluid such that the fluid swirls in the first direction in the swirl chamber and follows the low resistance flow path in the valve element. When the viscosity of the fluid is less than a second predetermined level, the fluid selector determines the fluid to be the non-selected fluid such that the fluid swirls in the second direction in the swirl chamber and follows the high resistance flow path in the valve element, thereby regulating the production rate of the fluid responsive to changes in the viscosity of the fluid.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those having ordinary skill in the art with the benefit of this disclosure.

In the specification, reference may be made to the spatial relationships between various components and to the spatial orientation of various aspects of components as depicted in the attached drawings. It will be recognized, however, by those having ordinary skill in the art after a complete reading of the present disclosure, that the devices, members, systems, elements, apparatuses, chambers, pathways and other like components described herein may be positioned in any desired orientation. Thus, the use of terms such as "above,"

"below," "upper," "lower" or other like terms to describe spatial relationships should be understood to describe relative spatial relationships, as the components described herein may be oriented in any desired direction. As used herein, the term "coupled" may include direct or indirect coupling by any means, including moving and/or non-moving mechanical connections.

Figure 1:
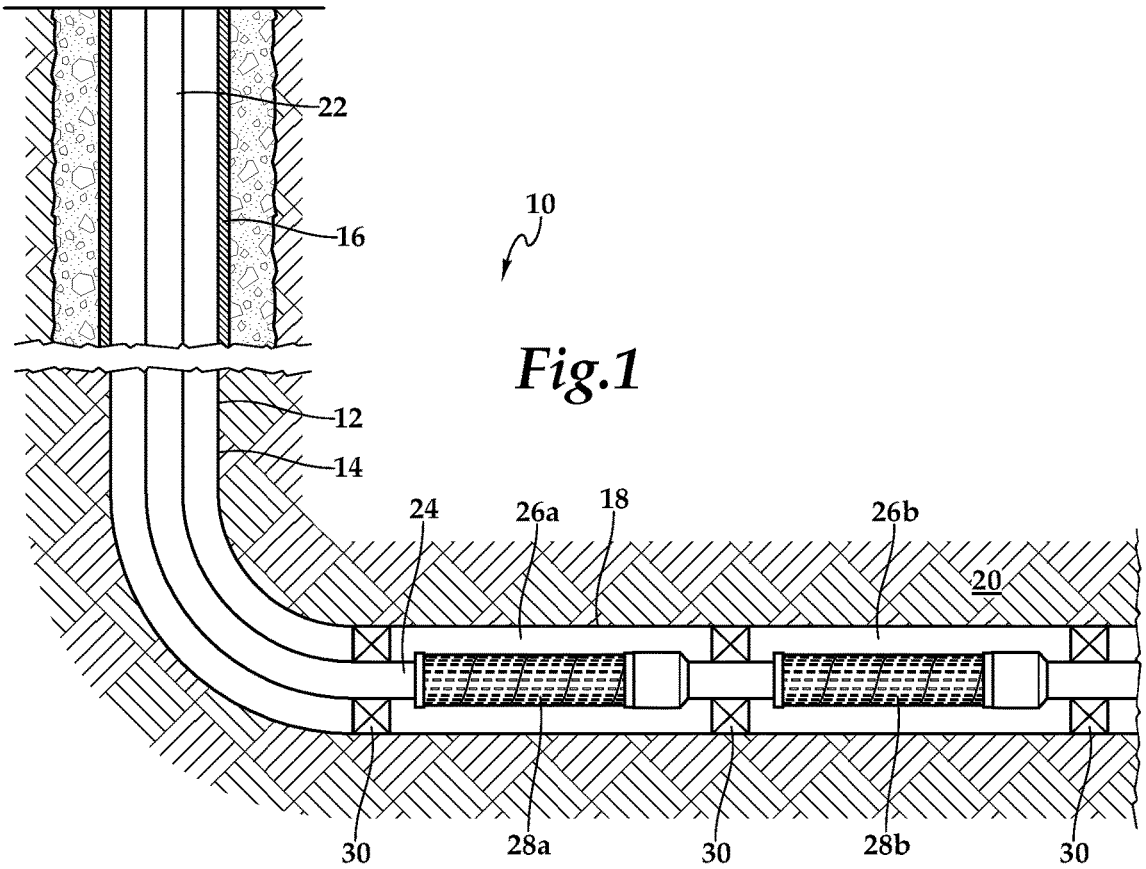
FIG. 1 is a schematic illustration of a well system operating a plurality of flow control screens according to embodiments of the present disclosure.

Referring initially to FIG. 1, therein is depicted a well system including a plurality of downhole fluid flow control systems positioned in flow control screens embodying principles of the present disclosure that is schematically illustrated and generally designated 10. In the illustrated embodiment, a wellbore 12 extends through the various earth strata. Wellbore 12 has a substantially vertical section 14, the upper portion of which includes a casing string 16 that has been cemented therein. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22 that provides a conduit for formation fluids to travel from formation 20 to the surface and/or for injection fluids to travel from the surface to formation 20. At its lower end, tubing string 22 is coupled to a completion string 24 that has been installed in wellbore 12 and divides the completion interval into various production intervals such as production intervals 26*a*, 26*b* that are adjacent to formation 20. Completion string 24 includes a plurality of flow control screens 28*a*, 28*b*, each of which is positioned between a pair of annular barriers depicted as packers 30 that provide a fluid seal between completion string 24 and wellbore 12, thereby defining production intervals 26*a*, 26*b*. In the illustrated embodiment, flow control screens 28*a*, 28*b* serve the functions of filtering particulate matter out of the production fluid stream as well as providing autonomous flow control as the proportions of the various fluid components in the production fluid change over time utilizing viscosity dependent adaptive fluid switches.

For example, the flow control sections of flow control screens 28*a*, 28*b* may be operable to control the inflow of a production fluid stream during the production phase of well operations. Alternatively or additionally, the flow control sections of flow control screens 28*a*, 28*b* may be operable to control the flow of an injection fluid stream during a treatment phase of well operations. As explained in greater detail herein, the flow control sections preferably control the inflow of production fluids from each production interval without the requirement for well intervention as the composition or fluid proportions of the production fluid entering specific intervals changes over time in order to maximize production of a selected fluid and minimize production of a non-selected fluid. For example, the present flow control screens may be tuned to maximize the production of oil and minimize the production of water. As another example, the present flow control screens may be tuned to maximize the production of oil and minimize the production of natural gas. In yet another example, the present flow control screens may be tuned to maximize the production of natural gas and minimize the production of water.

Even though FIG. 1 depicts the flow control screens of the present disclosure in an open hole environment, it should be understood by those having ordinary skill in the art that the present flow control screens are equally well suited for use in cased wells. Also, even though FIG. 1 depicts one flow control screen in each production interval, it should be understood by those having ordinary skill in the art that any number of flow control screens may be deployed within a production interval without departing from the principles of the present disclosure. In addition, even though FIG. 1 depicts the flow control screens in a horizontal section of the wellbore, it should be understood by those having ordinary skill in the art that the present flow control screens are equally well suited for use in wells having other directional configurations including vertical wells, deviated wells, slanted wells, multilateral wells and the like. Further, even though the flow control systems in FIG. 1 have been described as being associated with flow control screens in a tubular string, it should be understood by those having ordinary skill in the art that the flow control systems of the present disclosure need not be associated with a screen or be deployed as part of the tubular string. For example, one or more flow control systems may be deployed and removably inserted into the center of the tubing string or inside pockets of the tubing string.

Figure 2:
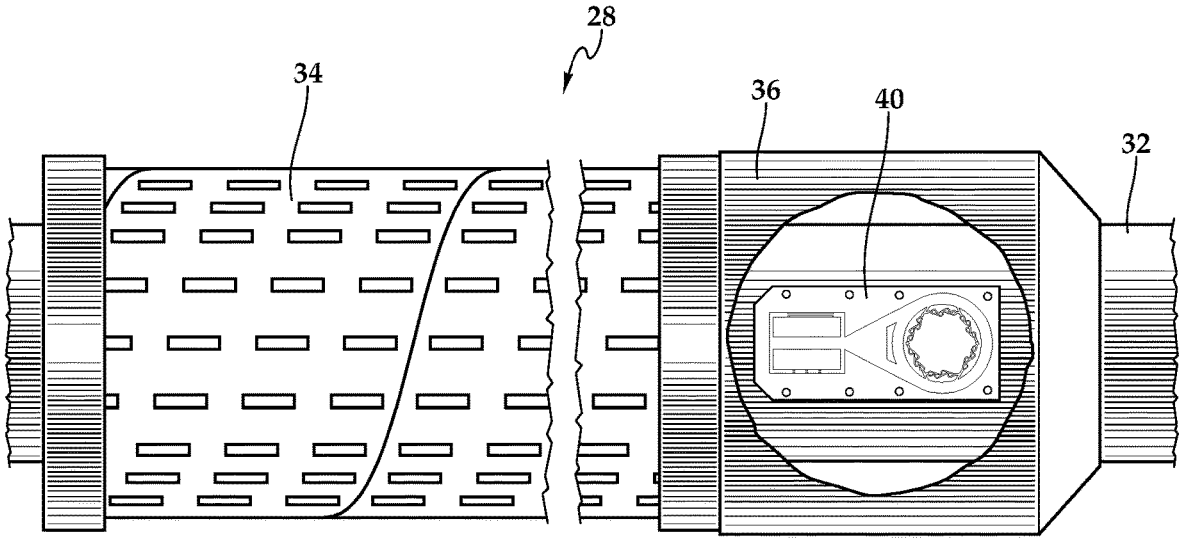
FIG. 2 is a top view of a flow control screen including an adaptive fluid switch according to embodiments of the present disclosure.

Referring next to FIG. 2, therein is depicted a flow control screen according to the present disclosure that is representatively illustrated and generally designated 28. Flow control screen 28 may be suitably coupled to other similar flow control screens, production packers, locating nipples, production tubulars or other downhole tools to form a completions string as described above. Flow control screen 28 includes a base pipe 32 that preferably has a blank pipe section disposed to the interior of a screen element or filter medium 34, such as a wire wrap screen, a woven wire mesh screen, a prepacked screen or the like, with or without an outer shroud positioned therearound, designed to allow fluids to flow therethrough but prevent particulate matter of a predetermined size from flowing therethrough. It will be understood, however, by those having ordinary skill in the art that the embodiments of the present disclosure not need have a filter medium associated therewith, accordingly, the exact design of the filter medium is not critical to the present disclosure.

Fluid produced through filter medium 34 travels toward and enters an annular area between outer housing 36 and base pipe 32. To enter the interior of base pipe 32, the fluid must pass through an adaptive fluid switch 40 and a perforated section of base pipe 32 that is disposed under adaptive fluid switch 40. In the illustrated embodiment, adaptive fluid switch 40 is seen through a cutaway section of outer housing 36 and with an upper plate of adaptive fluid switch 40 removed. The flow control system of each flow control screen 28 may include one or more adaptive fluid switches 40. In certain embodiments, adaptive fluid switches 40 may be circumferentially distributed about base pipe 32 such as at 180 degree intervals, 120 degree intervals, 90 degree intervals or other suitable distribution. Alternatively or additionally, adaptive fluid switches 40 may be longitudinally distributed along base pipe 32. Regardless of the exact configuration of adaptive fluid switches 40 on base pipe 32, any desired number of adaptive fluid switches 40 may be incorporated into a flow control screen 28, with the exact configuration depending upon factors that are known to those having ordinary skill in the art including the reservoir pressure, the expected composition of the production fluid, the desired production rate and the like. The various connections of the components of flow control screen 32 may be made in any suitable fashion including welding, threading and the like as well as through the use of fasteners such as pins, set screws and the like. Even though adaptive fluid switch 40 has been described and depicted as being coupled to the exterior of base pipe 32, it will be understood by those having ordinary skill in the art that the adaptive fluid switches of the present disclosure may be alternatively positioned such as within openings of the base pipe or to the interior of the base pipe so long as the adaptive fluid switches are positioned between the upstream or formation side and the downstream or base pipe interior side of the formation fluid path.

Adaptive fluid switches 40 may be operable to control the flow of fluid in both the production direction and the injection direction therethrough. For example, during the production phase of well operations, fluid flows from the formation into the production tubing through fluid flow control screen 28. The production fluid, after being filtered by filter medium 34, if present, flows into the annulus between base pipe 32 and outer housing 36. The fluid then enters adaptive fluid switch 40 where the desired flow operation occurs depending upon the viscosity, density, velocity or other interpreted fluid property of the produced fluid. For example, if a selected fluid such as oil is being produced, the flow through adaptive fluid switch 40 follows a low resistance flow path enabling a high flowrate. If a non-selected fluid such as water is being produced, the flow through adaptive fluid switch 40 follows a high resistance flow path creating a low flowrate.

Figure 3:
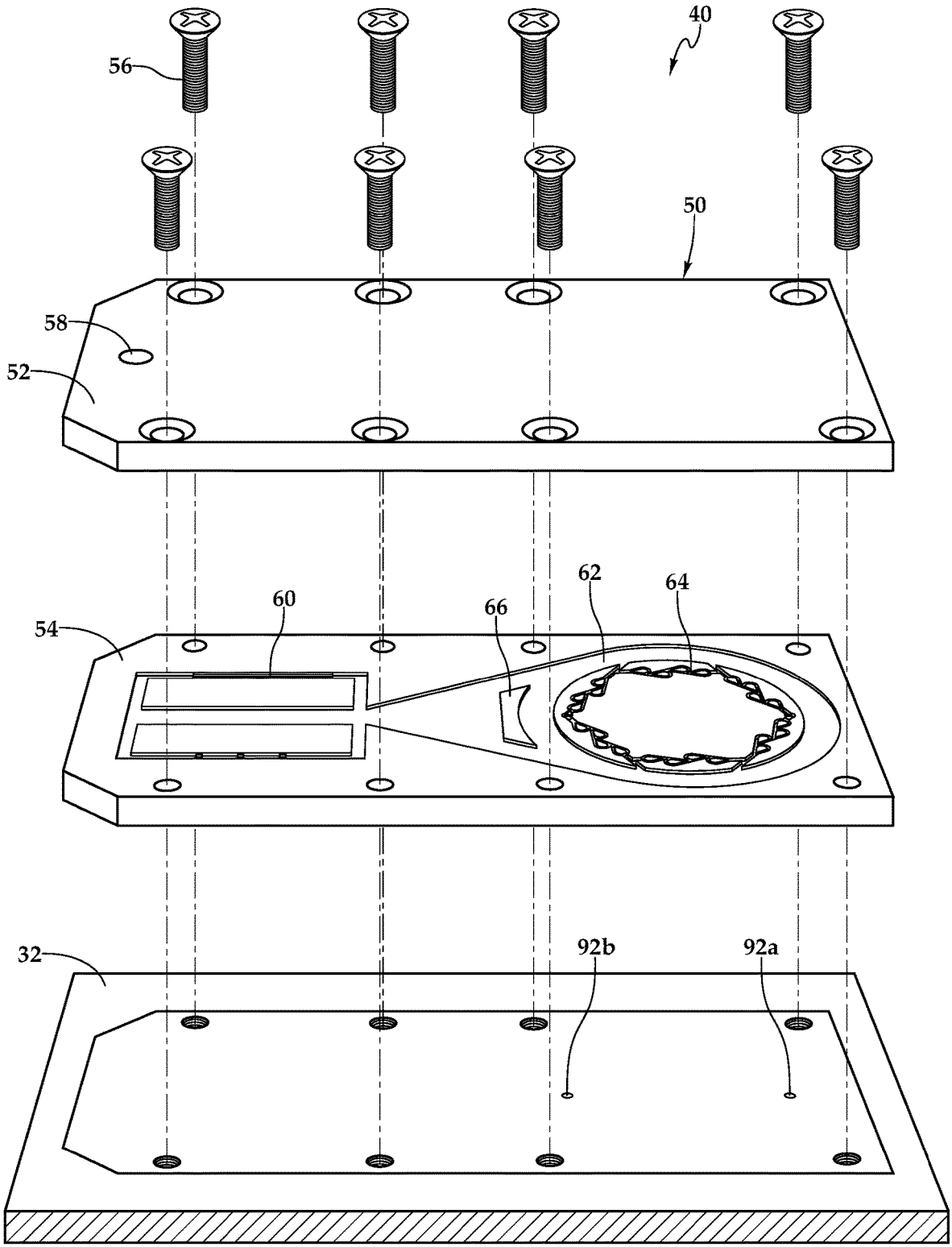
FIG. 3 is an exploded view of an adaptive fluid switch according to embodiments of the present disclosure.

Referring next to FIG. 3, an adaptive fluid switch for use in a downhole fluid flow control system of the present disclosure is representatively illustrated and generally designated 40. In the illustrated embodiment, adaptive fluid switch 40 includes a fluid control module 50 that is formed by coupling an outer plate 52 and an inner plate 54 to base pipe 32 with a plurality of fasteners depicted as screws 56. As illustrated, outer plate 52, an inner plate 54 and base pipe 32 have matching hole patterns that enable screws 56 to pass through outer plate 52 and inner plate 54 and to threadedly couple with base pipe 32 to form fluid control module 50. Outer plate 52 and inner plate 54 may be metal plates formed from a stainless steel, a titanium alloy, a nickel alloy, a tungsten carbide or other suitable corrosion resistant material.

Adaptive fluid switch 40 has an inlet 58 that extends at least partially through outer plate 52. Adaptive fluid switch 40 also includes a fluid selector 60, a swirl chamber 62, a self-impinging valve element 64 and a deflector 66 which can be seen on an upper surface of inner plate 54. Alternatively, fluid selector 60, swirl chamber 62, self-impinging valve element 64 and deflector 66 could be on the lower surface of outer plate 52. As another alternative, the upper surface of inner plate 54 and the lower surface of outer plate 52 could each include a portion of fluid selector 60, swirl chamber 62, self-impinging valve element 64 and deflector 66 such that these features are fully formed when outer plate 52 and inner plate 54 are mated together to form fluid control module 50 and/or coupled to base pipe 32. Fluid selector 60, swirl chamber 62, self-impinging valve element 64 and deflector 66 may be formed on inner plate 54 and/or outer plate 52 by a material removal process such as machining, etching or the like or by an additive manufacturing process such as deposition, 3D printing, laser melting or the like.

Figure 4A:
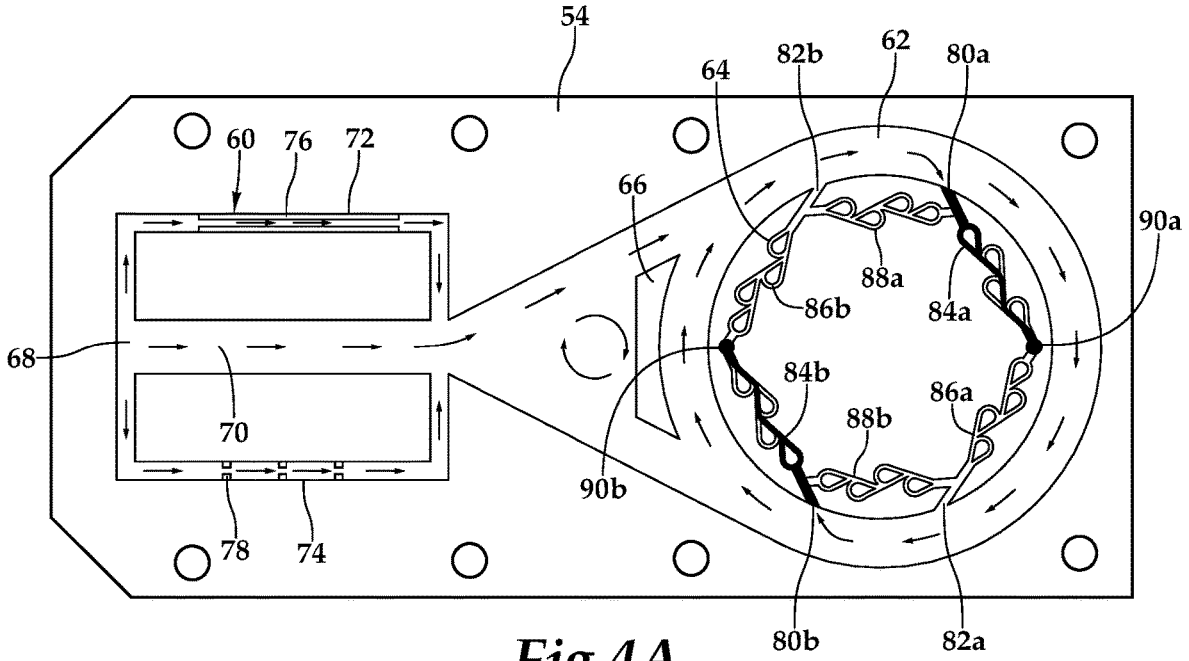
FIGS. 4A-4D are top views of an inner plate of an adaptive fluid switch according to embodiments of the present disclosure.
Figure 4B:
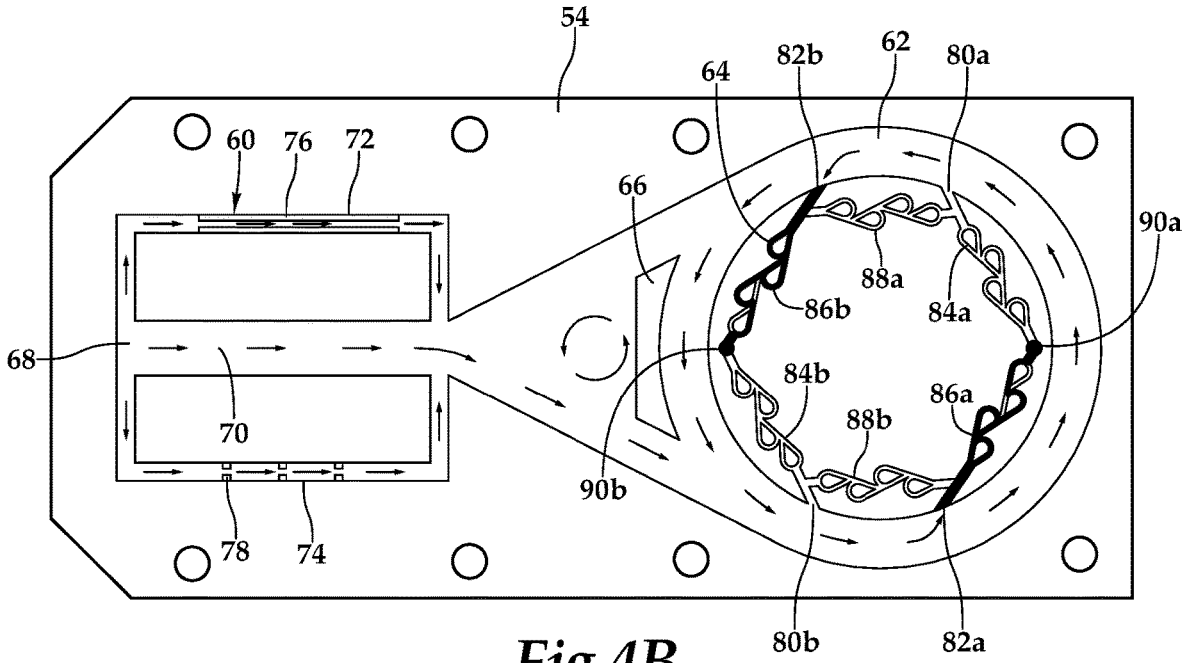

Referring additionally to FIGS. 4A-4B, top views of inner plate 54 including fluid selector 60, swirl chamber 62, self-impinging valve element 64 and deflector 66 are depicted. In the illustrated embodiment, fluid selector 60 is configured to interpret the viscosity of a fluid flowing therethrough to determine whether the fluid is a selected fluid, such oil, or a non-selected fluid, such as natural gas or water. Specifically, fluid selector 60 includes an inlet region 68 that is aligned with inlet 58 of outer plate 52. Fluid selector 60 also includes a main flow path 70, a viscosity dominated flow path 72 and an inertia dominated flow path 74. In the illustrated embodiment, viscosity dominated flow path 72 includes a resistor 76 in the form of one or more flow tubes that tends to create an increasing resistance to flow with increasing fluid viscosity. Inertia dominated flow path 74 includes a resistor 78 in the form of one or more orifices that tends to create an increasing resistance to flow with increasing fluid momentum.

As an example, when the fluid flowing through adaptive fluid switch 40 (represented by arrows) has a viscosity greater than a first predetermined level, such as a fluid having a viscosity between 1 and 10 centipoises, more fluid will exit inertia dominated flow path 74 than viscosity dominated flow path 72. As the fluid exiting inertia dominated flow path 74 and viscosity dominated flow path 72 interact with fluid from main flow path 70 in opposing transverse directions, the higher flowrate exiting inertia dominated flow path 74 will cause fluid from main flow path 70 to be urged in the upward direction, as best seen in FIG. 4A. Continuing with this example, when the fluid flowing through adaptive fluid switch 40 has a viscosity less than a second predetermined level, such as a fluid having a viscosity between 0.1 and 1 centipoise, more fluid will exit viscosity dominated flow path 72 than inertia dominated flow path 74 causing fluid from main flow path 70 to be urged in the downward direction, as best seen in FIG. 4B. In this example, when the fluid flowing through adaptive fluid switch 40 is the selected fluid of oil, which has a viscosity greater than the first predetermined level, the selected fluid will be directed upwardly as it exits fluid selector 60. Similarly, when the fluid flowing through adaptive fluid switch 40 is the non-selected fluid of water or natural gas, which have a viscosity less than the second predetermined level, the non-selected fluid will be directed downwardly as it exits fluid selector 60. In this manner, fluid selector 60 interprets the viscosity of the fluid flowing through adaptive fluid switch 40, determines whether the fluid is a selected fluid, such as oil, or a non-selected fluid, such as natural gas or water, and directs the fluid either upwardly or downwardly responsive thereto.

The first and second predetermined levels of fluid selector 60 may be tuned based upon the specific implementations of resistors 76, 78 as well as the relative resistances of resistors 76, 78. If it is desired to discriminate between fluids having similar viscosities, such as light crude oil and water, the ratio between the first predetermined level and the second predetermined level may be about 2 to 1 or less. To discriminate between fluids having less similar viscosities, such as medium or heavy crude oil and water, the ratio between the first predetermined level and the second predetermined level may be about 10 to 1 or greater. It is noted that production fluids are commonly multiphase fluids including oil, natural gas, water and/or other fractional components. When the fluid flowing through adaptive fluid switch 40 is a multiphase fluid, fluid selector 60 interprets the viscosity of the fluid as an effective viscosity of a single phase fluid. In this manner, when the proportions and thus the viscosity of the production fluid changes over time, fluid selector 60 determines whether the fluid is a selected fluid, one with a viscosity greater than the first predetermined level, or a non-selected fluid, one with a viscosity less than the second predetermined level. Thus, as the ratio of the water fraction to the oil fraction in a production fluid increases, fluid selector 60 is configured to transition the production fluid from being a selected fluid to being a non-selected fluid.

Swirl chamber 62 is positioned downstream of fluid selector 60. Swirl chamber 62 has a generally annular pathway configured to induce swirling flow in the production fluid. With the aid of fluid selector 60 and deflector 66, when the fluid flowing through adaptive fluid switch 40 is the selected fluid, the fluid is directed to swirl in a clockwise direction in swirl chamber 62, as best seen in FIG. 4A. Likewise, with the aid of fluid selector 60 and deflector 66, when the fluid flowing through adaptive fluid switch 40 is the non-selected fluid, the fluid is directed to swirl in a counter-clockwise direction in swirl chamber 62, as best seen in FIG. 4B.

Self-impinging valve element 64 is disposed downstream of swirl chamber 62 and is positioned radially inwardly of swirl chamber 62 such that fluid swirling within swirl chamber 62 that spirals radially inwardly enters self-impinging valve element 64. In the illustrated embodiment, self-impinging valve element 64 has multiple valve inlets including two valve inlets 80*a*, 80*b* that are oriented to preferentially receive fluid that is swirling in the clockwise direction and two valve inlets 82*a*, 82*b* that are oriented to preferentially receive fluid that is swirling in the counter-clockwise direction. Self-impinging valve element 64 is depicted as a multistage self-impinging ring valve element in the form of a tesla ring valve element having a plurality of parallel branches such as parallel branches 84*a*, 84*b* respectively coupled to valve inlets 80*a*, 80*b*, parallel branches 86*a*, 86*b* respectively coupled to valve inlets 82*a*, 82*b* and parallel branches 88*a*, 88*b* that respectively extend between branches 84*a*, 86*b* and branches 84*b*, 86*a*. Self-impinging valve element 64 has a plurality of valve outlets depicted as two valve outlets 90*a*, 90*b* that are aligned with and in fluid communication with discharge ports 92*a*, 92*b* of base pipe 32, which may be considered to be the outlets of flow control module 50. It should be noted that the use of the term parallel branches does not imply that the branches are physically parallel to each other but rather that their terminals are connected to common pressure nodes, in this case, swirl chamber 62 and valve outlets 90*a*, 90*b*.

Figure 12A:
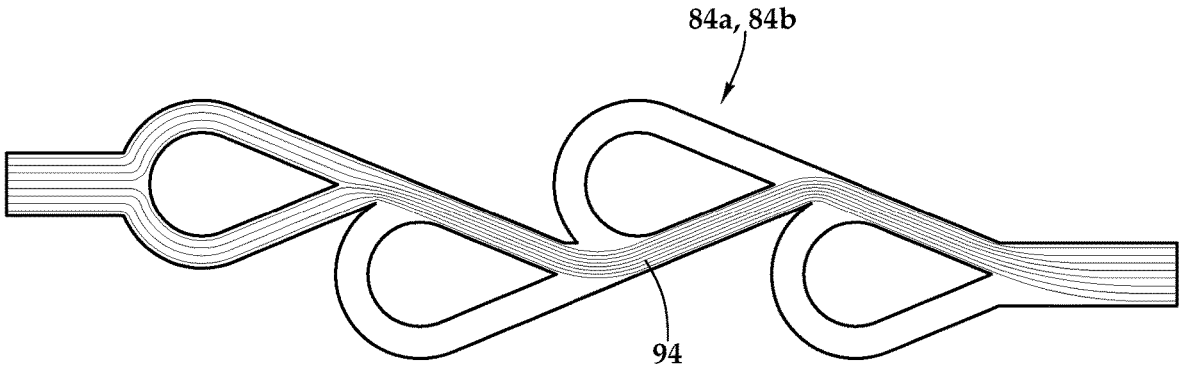
FIGS. 12A-12B are flow diagrams depicting fluid traveling through a fluid conduit of a multistage self-impinging valve element for use in an adaptive fluid switch according to embodiments of the present disclosure.
Figure 12B:
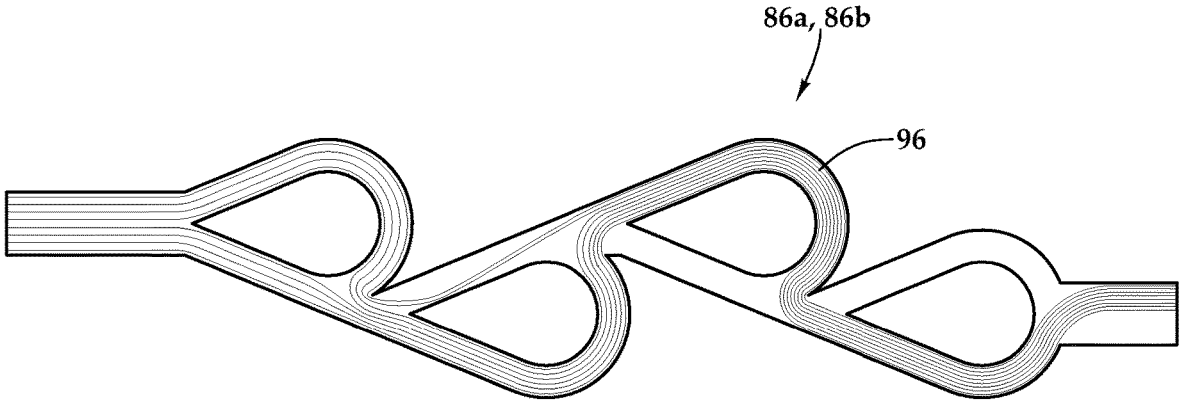

Branches 84*a*, 84*b* of self-impinging valve element 64 provide a flow path with low flow resistance while branches 86*a*, 86*b* of self-impinging valve element 64 provide a flow path with high flow resistance. Specifically, fluid flow from valve inlet 80*a* to valve outlet 90*a* flows unimpeded through branch 84*a* and fluid flow from valve inlet 80*b* to valve outlet 90*b* flows unimpeded through branch 84*b*. This flow is best seen in FIG. 12A that depicts a tesla valve conduit that is representative of branches 84*a*, 84*b* with flow progressing from left to right in the unimpeded direction with little resistance, thereby providing a high flowrate path in which the depicted streamlines flow through a compliant flow path 94 down the middle of the conduit with minimal losses. Conversely, fluid flow from valve inlet 82*a* to valve outlet 90*a* flows impingingly through branch 86*a* and fluid flow from valve inlet 82*b* to valve outlet 90*b* flows impingingly through branch 86*b*. This flow is best seen in FIG. 12B that depicts a tesla valve conduit that is representative of branches 86*a*, 86*b* with flow progressing from left to right in the impinging direction with considerable resistance, thereby providing a low flowrate path in which the depicted streamlines flow through an impinging flow path 96 following a serpentine, turbulent and self-impinging path around outside channels of the conduit creating large losses.

The operation of adaptive fluid switch 40 will now be described with four different fluids flowing therethrough. For the present example, resistors 76, 78 have been tuned such that the first predetermined level is about 2 centipoises and the second predetermined level is about 1 centipoise. In FIG. 4A, the fluid flowing through adaptive fluid switch 40 represents a light to medium crude oil having a viscosity between 10 and 100 centipoises. The fluid enters fluid selector 60 at inlet region 68 from inlet 58 of outer plate 52. The fluid flows through main flow path 70, viscosity dominated flow path 72 and inertia dominated flow path 74. As the fluid has a viscosity greater than the first predetermined level, more fluid exits inertia dominated flow path 74 than viscosity dominated flow path 72 such that the fluid from main flow path 70 is urged upwardly, directing the fluid toward the top of swirl chamber 62. The fluid is now induced to swirl in the clockwise direction in swirl chamber 62 with portions of the fluid spiraling radially inwardly to enter self-impinging valve element 64 at valve inlets 80*a*, 80*b* that are oriented to preferentially receive fluid that is swirling in the clockwise direction. The fluid then follows the low resistance flow paths (see FIG. 12A) through branches 84*a*, 84*b*, as indicated by the solid lines therein, to valve outlets 90*a*, 90*b*, thereby maintaining a high flowrate. A negligible volume of fluid may also flow from swirl chamber 62 to valve outlets 90*a*, 90*b* through branches 86*a*, 86*b* and/or branches 88*a*, 88*b*. In this manner, production of light to medium oil is maximized.

In FIG. 4B, the fluid flowing through adaptive fluid switch 40 represents water having a viscosity between 0.5 and 1 centipoise. The fluid enters fluid selector 60 at inlet region 68 from inlet 58 of outer plate 52. The fluid flows through main flow path 70, viscosity dominated flow path 72 and inertia dominated flow path 74. As the fluid has a viscosity less than the second predetermined level, more fluid exits viscosity dominated flow path 72 than inertia dominated flow path 74 such that the fluid from main flow path 70 is urged downwardly, directing the fluid toward the bottom of swirl chamber 62. The fluid is now induced to swirl in the counter-clockwise direction in swirl chamber 62 with portions of the fluid spiraling radially inwardly to enter self-impinging valve element 64 at valve inlets 82*a*, 82*b* that are oriented to preferentially receive fluid that is swirling in the counter-clockwise direction. The fluid then follows the high resistance flow paths (see FIG. 12B) through branches 86*a*, 86*b*, as indicated by the solid lines therein, to valve outlets 90*a*, 90*b*, thereby having a low flowrate. A negligible volume of fluid may also flow from swirl chamber 62 to valve outlets 90*a*, 90*b* through branches 84*a*, 84*b* and/or branches 88*a*, 88*b*. In this manner, production of water is minimized.

Figure 4C:
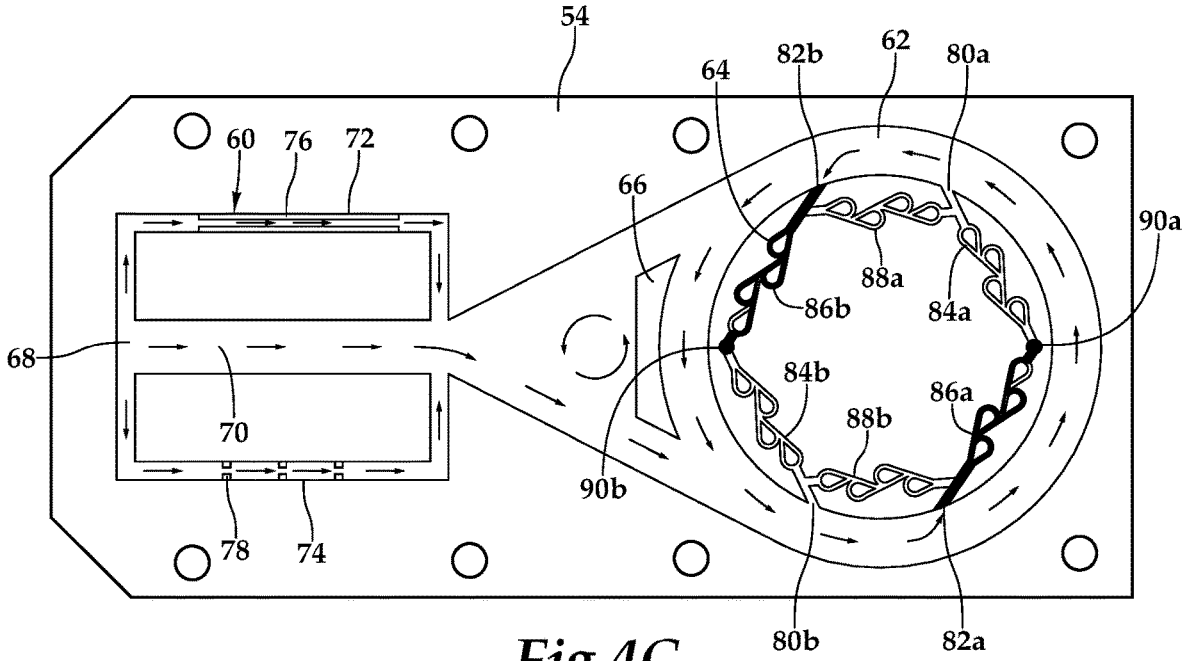

In FIG. 4C, the fluid flowing through adaptive fluid switch 40 represents natural gas having a viscosity between 0.02 and 0.1 centipoises. The fluid enters fluid selector 60 at inlet region 68 from inlet 58 of outer plate 52. The fluid flows through main flow path 70, viscosity dominated flow path 72 and inertia dominated flow path 74. As the fluid has a viscosity less than the second predetermined level, more fluid exits viscosity dominated flow path 72 than inertia dominated flow path 74 such that the fluid from main flow path 70 is urged downwardly, directing the fluid toward the bottom of swirl chamber 62. The fluid is now induced to swirl in the counter-clockwise direction in swirl chamber 62 with portions of the fluid spiraling radially inwardly to enter self-impinging valve element 64 at valve inlets 82*a*, 82*b* that are oriented to preferentially receive fluid that is swirling in the counter-clockwise direction. The fluid then follows the high resistance flow paths (see FIG. 12B) through branches 86*a*, 86*b*, as indicated by the solid lines therein, to valve outlets 90*a*, 90*b*, thereby having a low flowrate. A negligible volume of fluid may also flow from swirl chamber 62 to valve outlets 90*a*, 90*b* through branches 84*a*, 84*b* and/or branches 88*a*, 88*b*. In this manner, production of natural gas is minimized.

Figure 4D:
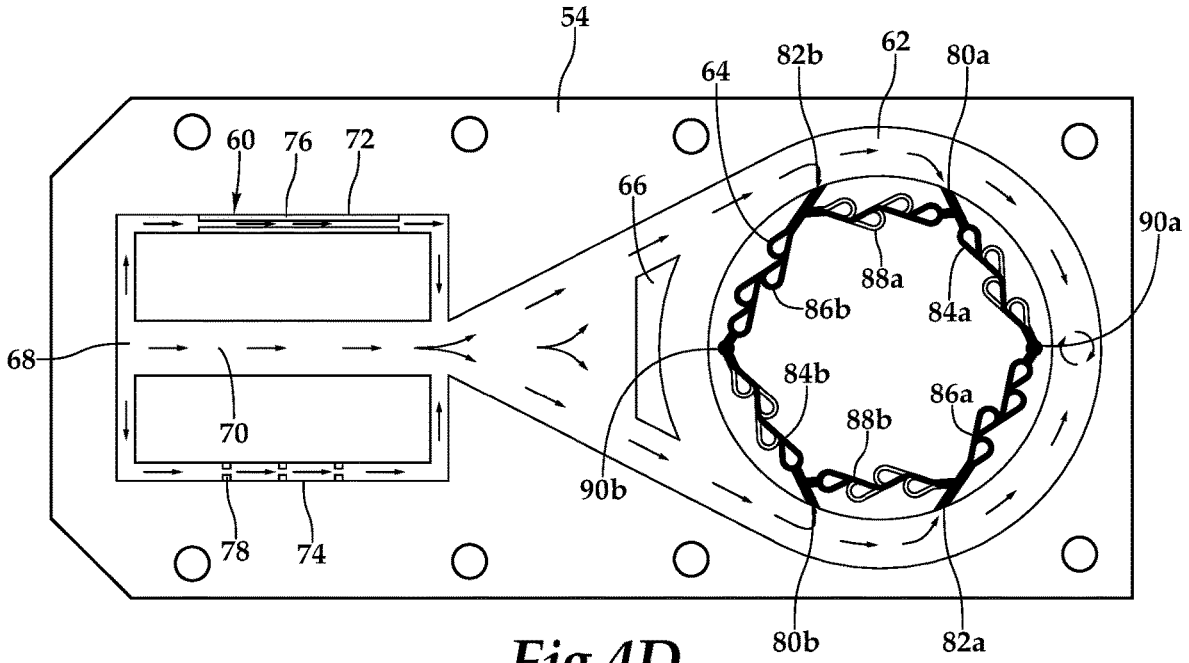

In FIG. 4D, the fluid flowing through adaptive fluid switch 40 represents a heavy crude oil having a viscosity between 500 and 1000 centipoises. The fluid enters fluid selector 60 at inlet region 68 from inlet 58 of outer plate 52. The fluid flows through main flow path 70, viscosity dominated flow path 72 and inertia dominated flow path 74. Due to the high viscosity of the fluid, however, instead of being directed toward the top of swirl chamber 62, the fluid diverges as it exits main flow path 70 entering swirl chamber 62 from both the top and the bottom. The fluid is not induced to swirl in swirl chamber 62 but rather enters each of valve inlets 80*a*, 80*b*, 82*a*, 82*b*. A portion of the fluid then follows the low resistance flow paths (see FIG. 12A) through branches 84*a*, 84*b*, as indicated by the solid lines therein, to valve outlets 90*a*, 90*b*. In addition, a portion of the fluid follows the high resistance flow paths (see FIG. 12B) through branches 86*a*, 86*b*, as indicated by the solid lines therein, to valve outlets 90*a*, 90*b*. A portion of the fluid also follows the low resistance flow paths (see FIG. 12A) through branches 88*a*, 88*b*, as indicated by the solid lines therein, from branch 86*a* to branch 84*b* and from branch 86*b* to branch 84*a* and eventually to valve outlets 90*a*, 90*b*. In this manner, production of heavy oil is maximized.

Figure 5A:
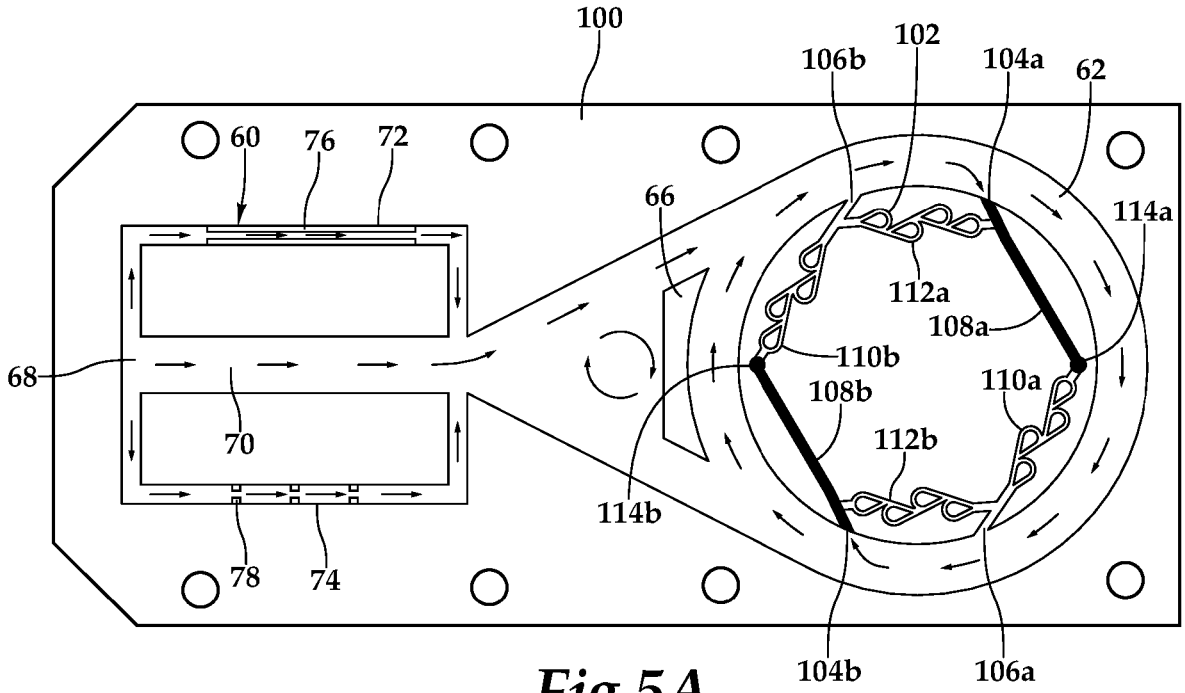
FIGS. 5A-5B are top views of an inner plate of an adaptive fluid switch according to embodiments of the present disclosure.
Figure 5B:
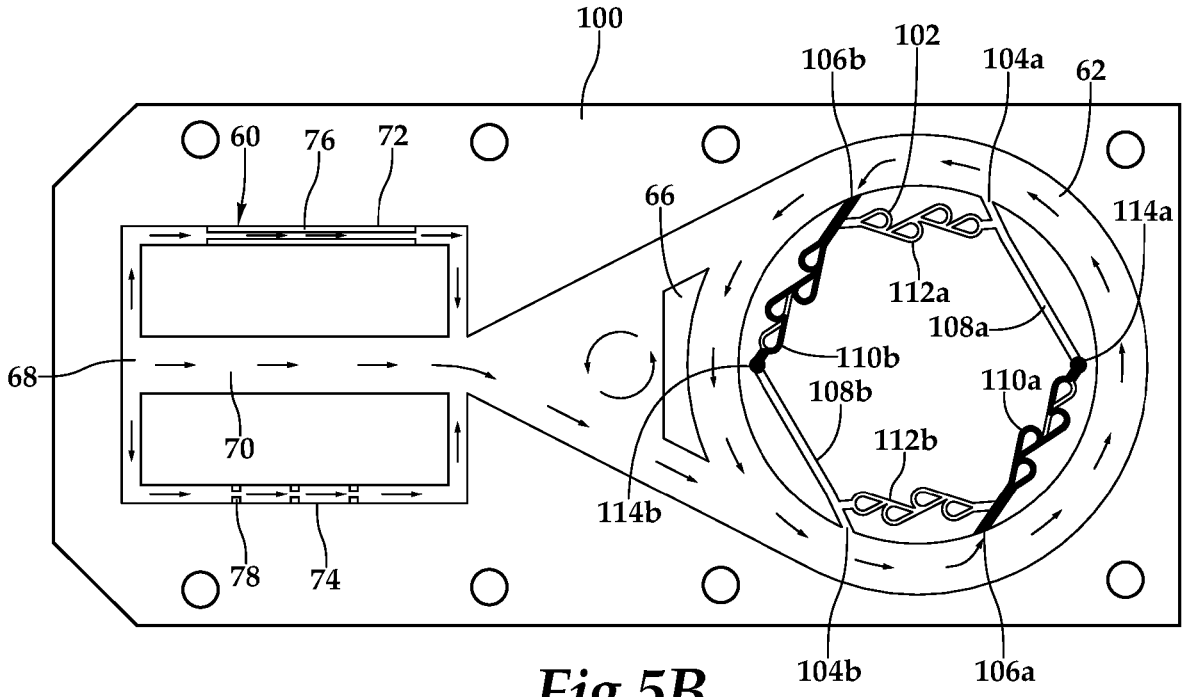

Referring next to FIGS. 5A-5B of the drawings, top views of an inner plate 100 of an adaptive fluid switch of the present disclosure are depicted. Inner plate 100 includes fluid selector 60, swirl chamber 62 and deflector 66 as described above. Inner plate 100 includes an alternate valve element depicted as a multistage self-impinging ring valve element 102 having multiple valve inlets including two valve inlets 104*a*, 104*b* that are oriented to preferentially receive fluid that is swirling in the clockwise direction and two valve inlets 106*a*, 106*b* that are oriented to preferentially receive fluid that is swirling in the counter-clockwise direction. Valve element 102 has a plurality of parallel branches such as parallel branches 108*a*, 108*b* respectively coupled to valve inlets 104*a*, 104*b*, parallel branches 110*a*, 110*b* respectively coupled to valve inlets 106*a*, 106*b* and parallel branches 112*a*, 112*b* that respectively extend between branches 108*a*, 110*b* and branches 108*b*, 110*a*. Valve element 102 has a plurality of valve outlets depicted as two valve outlets 114*a*, 114*b* that would be aligned with and in fluid communication with discharge ports of base pipe 32. Branches 108*a*, 108*b* of valve element 102 provide flow paths without tesla conduits that provide low flow resistance while branches 110*a*, 110*b* of valve element 102 provide flow paths with high flow resistance (see FIG. 12B).

The operation of an adaptive fluid switch with inner plate 100 will now be described with two different fluids flowing therethrough. For the present example, resistors 76, 78 have been tuned such that the first predetermined level is about 2 centipoises and the second predetermined level is about 1 centipoise. In FIG. 5A, the fluid flowing through the adaptive fluid switch represents oil having a viscosity between 10 and 100 centipoises. The fluid enters fluid selector 60 at inlet region 68 then flows through main flow path 70, viscosity dominated flow path 72 and inertia dominated flow path 74. As the fluid has a viscosity greater than the first predetermined level, more fluid exits inertia dominated flow path 74 than viscosity dominated flow path 72 such that the fluid from main flow path 70 is urged upwardly, directing the fluid toward the top of swirl chamber 62. The fluid is now induced to swirl in the clockwise direction in swirl chamber 62 with portions of the fluid spiraling radially inwardly to enter valve element 102 at valve inlets 104*a*, 104*b* that are oriented to preferentially receive fluid that is swirling in the clockwise direction. The fluid then follows the low resistance flow paths through branches 108*a*,108*b*, as indicated by the solid lines therein, to valve outlets 114*a*, 114*b*, thereby maintaining a high flowrate. A negligible volume of fluid may also flow from the swirl chamber to the valve outlets through the other branches. In this manner, production of oil is maximized.

In FIG. 5B, the fluid flowing through the adaptive fluid switch represents water or natural gas having a viscosity between 0.02 and 1 centipoise. The fluid enters fluid selector 60 at inlet region 68 then flows through main flow path 70, viscosity dominated flow path 72 and inertia dominated flow path 74. As the fluid has a viscosity less than the second predetermined level, more fluid exits viscosity dominated flow path 72 than inertia dominated flow path 74 such that the fluid from main flow path 70 is urged downwardly, directing the fluid toward the bottom of swirl chamber 62. The fluid is now induced to swirl in the counter-clockwise direction in swirl chamber 62 with portions of the fluid spiraling radially inwardly to enter self-impinging valve element 64 at valve inlets 106*a*, 106*b* that are oriented to preferentially receive fluid that is swirling in the counter-clockwise direction. The fluid then follows the high resistance flow paths (see FIG. 12B) through branches 110*a*, 110*b*, as indicated by the solid lines therein, to valve outlets 114*a*, 114*b*, thereby having a low flowrate. A negligible volume of fluid may also flow from the swirl chamber to the valve outlets through the other branches. In this manner, production of natural gas and/or water is minimized.

Figure 6A:
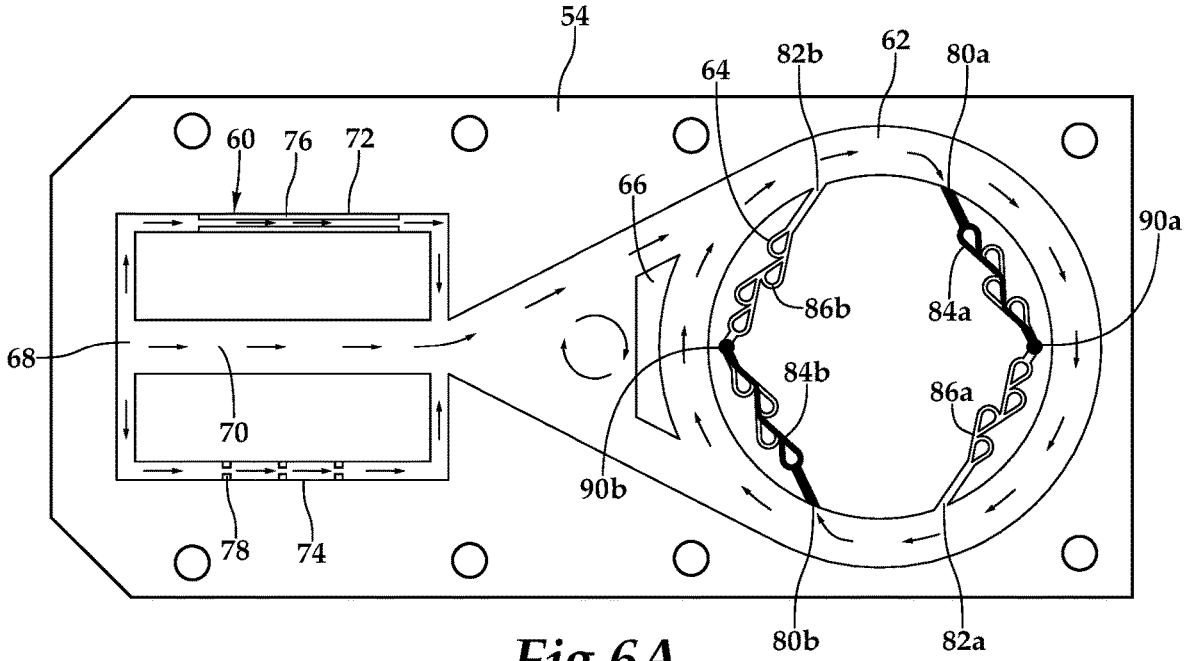
FIGS. 6A-6B are top views of an inner plate of an adaptive fluid switch according to embodiments of the present disclosure.
Figure 6B:
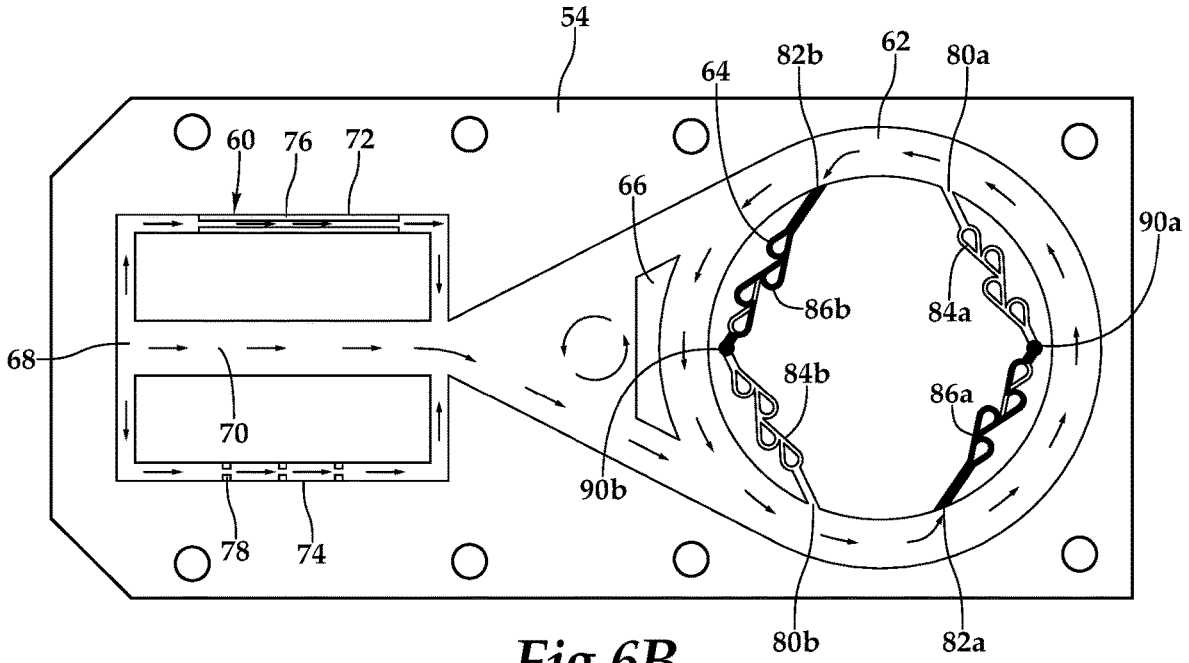

Referring next to FIGS. 6A-6B of the drawings, a modified embodiment of inner plate 54 of FIGS. 4A-4D is depicted. Inner plate 54 includes fluid selector 60, swirl chamber 62 and deflector 66 as described above. In addition, inner plate 54 includes a modified configuration of self-impinging valve element 64 in which branches 88*a*, 88*b* have been removed. This embodiment will operate substantially the same as the embodiment of FIGS. 4A-4B when the fluid flowing therethrough is light to medium oil (see FIG. 4A), water (see FIG. 4B) or natural gas (see FIG. 4C). This embodiment, however, may be less well suited for maximizing heavy oil production which takes advantage of branches 88*a*, 88*b* in the embodiment shown of FIGS. 4A-4D.

Figure 7A:
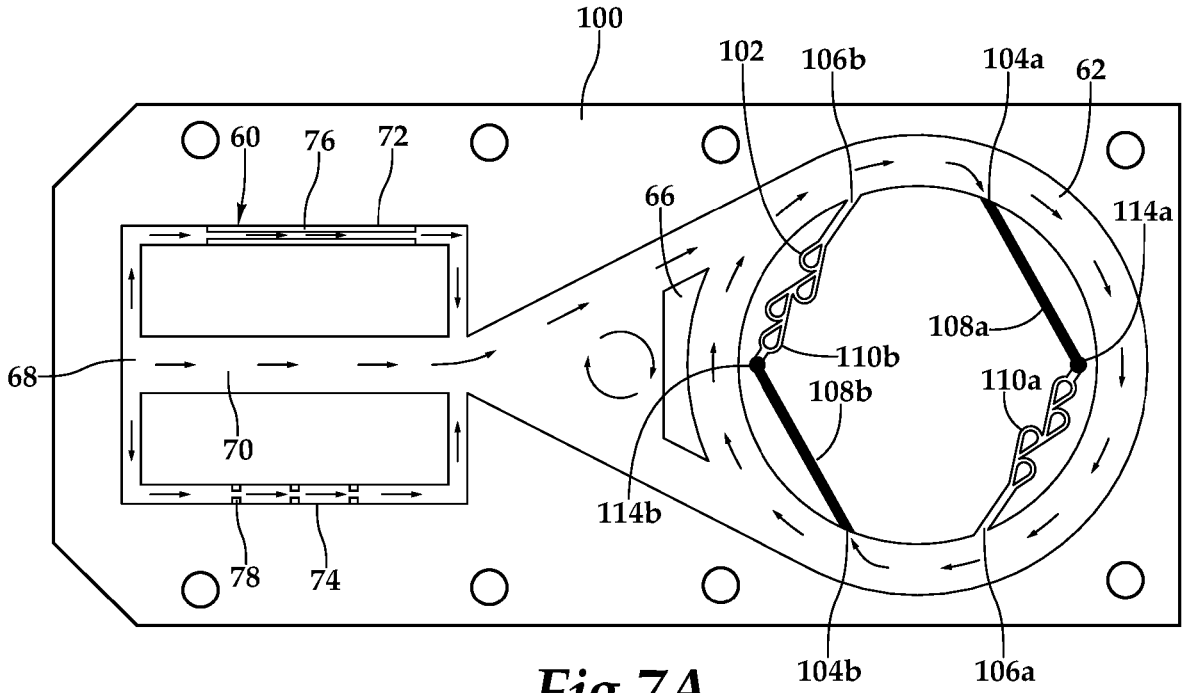
FIGS. 7A-7B are top views of an inner plate of an adaptive fluid switch according to embodiments of the present disclosure.
Figure 7B:
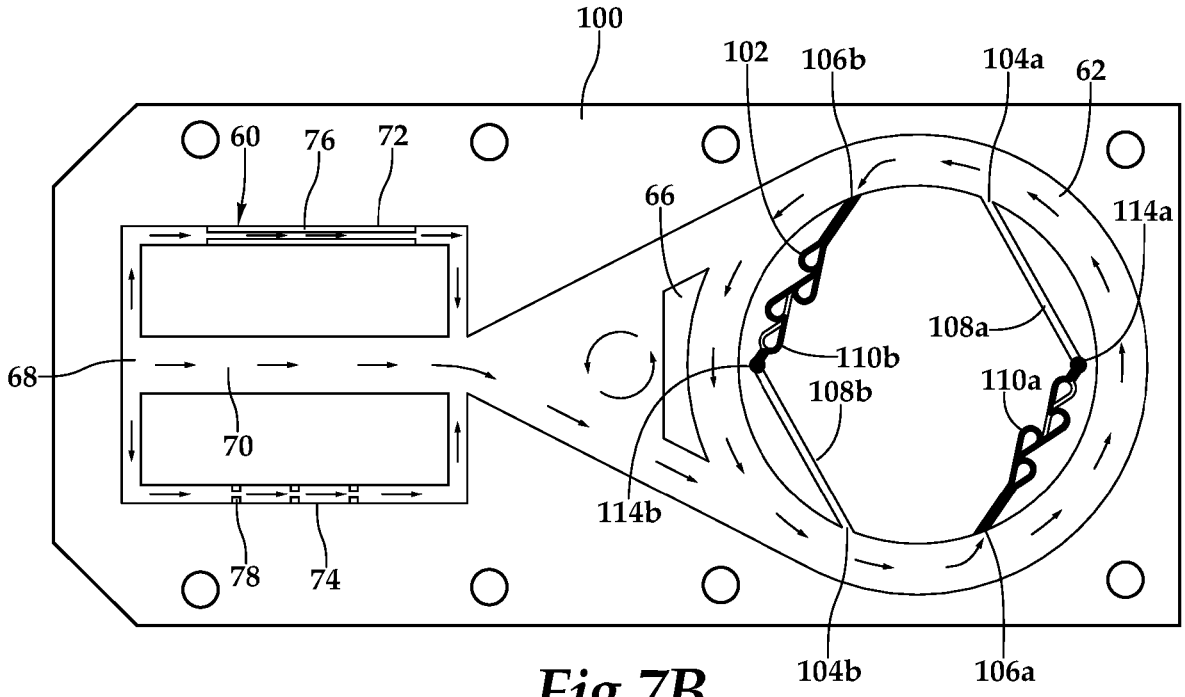

Referring next to FIGS. 7A-7B of the drawings, a modified embodiment of inner plate 100 of FIGS. 5A-5B is depicted. Inner plate 100 includes fluid selector 60, swirl chamber 62 and deflector 66 as described above. In addition, inner plate 100 includes a modified configuration of valve element 102 in which branches 112*a*, 112*b* have been removed. This embodiment will operate substantially the same as the embodiment of FIGS. 5A-5B when the fluid flowing therethrough is light to medium oil (see FIG. 5A), water (see FIG. 5B) or natural gas (see FIG. 5B). This embodiment, however, may be less well suited for maximizing heavy oil production which would take advantage of branches 112*a*, 112*b* in the embodiment shown of FIGS. 5A-5B.

Figure 8A:
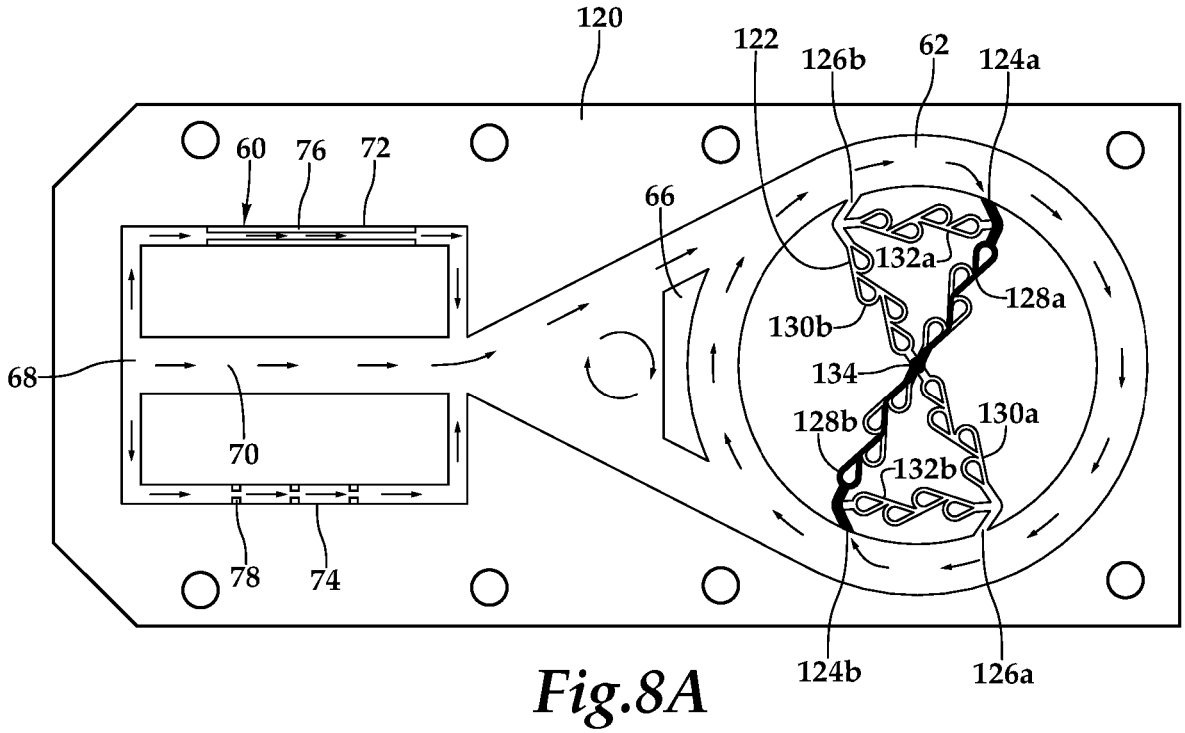
FIGS. 8A-8B are top views of an inner plate of an adaptive fluid switch according to embodiments of the present disclosure.
Figure 8B:
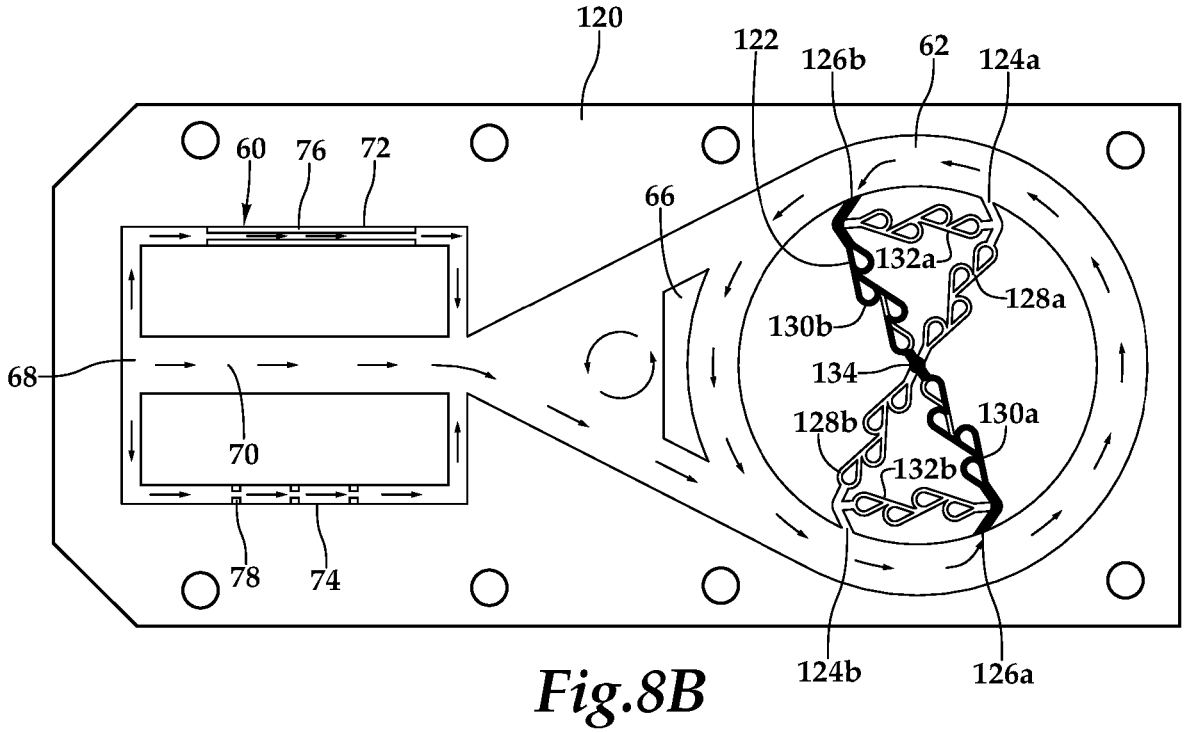

Referring next to FIGS. 8A-8B of the drawings, top views of an inner plate 120 of an adaptive fluid switch of the present disclosure are depicted. Inner plate 120 includes fluid selector 60, swirl chamber 62 and deflector 66 as described above. Inner plate 120 includes an alternate valve element depicted as a multistage self-impinging bow valve element 122 having multiple valve inlets including two valve inlets 124*a*, 124*b* that are oriented to preferentially receive fluid that is swirling in the clockwise direction and two valve inlets 126*a*, 126*b* that are oriented to preferentially receive fluid that is swirling in the counter-clockwise direction. Valve element 122 has a plurality of parallel branches such as parallel branches 128*a*, 128*b* respectively coupled to valve inlets 124*a*, 124*b*, parallel branches 130*a*, 130*b* respectively coupled to valve inlets 126*a*, 126*b* and parallel branches 132*a*, 132*b* that respectively extend between branches 128*a*, 130*b* and branches 128*b*, 130*a*. Valve element 102 has a single valve outlet 134 that would be aligned with and in fluid communication with a discharge port of base pipe 32.

The operation of an adaptive fluid switch with inner plate 120 will now be described with two different fluids flowing therethrough. For the present example, resistors 76, 78 have been tuned such that the first predetermined level is about 2 centipoises and the second predetermined level is about 1 centipoise. In FIG. 8A, the fluid flowing through the adaptive fluid switch represents oil having a viscosity between 10 and 100 centipoises. The fluid enters fluid selector 60 at inlet region 68 then flows through main flow path 70, viscosity dominated flow path 72 and inertia dominated flow path 74. As the fluid has a viscosity greater than the first predetermined level, more fluid exits inertia dominated flow path 74 than viscosity dominated flow path 72 such that the fluid from main flow path 70 is urged upwardly, directing the fluid toward the top of swirl chamber 62. The fluid is now induced to swirl in the clockwise direction in swirl chamber 62 with portions of the fluid spiraling radially inwardly to enter valve element 122 at valve inlets 124*a*, 124*b* that are oriented to preferentially receive fluid that is swirling in the clockwise direction. The fluid then follows the low resistance flow paths (see FIG. 12A) through branches 128*a*, 128*b*, as indicated by the solid lines therein, to valve outlet 134, thereby maintaining a high flowrate. A negligible volume of fluid may also flow from the swirl chamber to the valve outlet through the other branches. In this manner, production of oil is maximized.

In FIG. 8B, the fluid flowing through the adaptive fluid switch represents water or natural gas having a viscosity between 0.02 and 1 centipoise. The fluid enters fluid selector 60 at inlet region 68 then flows through main flow path 70, viscosity dominated flow path 72 and inertia dominated flow path 74. As the fluid has a viscosity less than the second predetermined level, more fluid exits viscosity dominated flow path 72 than inertia dominated flow path 74 such that the fluid from main flow path 70 is urged downwardly, directing the fluid toward the bottom of swirl chamber 62. The fluid is now induced to swirl in the counter-clockwise direction in swirl chamber 62 with portions of the fluid spiraling radially inwardly to enter valve element 122 at valve inlets 126*a*, 126*b* that are oriented to preferentially receive fluid that is swirling in the counter-clockwise direction. The fluid then follows the high resistance flow paths (see FIG. 12B) through branches 130*a*, 130*b*, as indicated by the solid lines therein, to valve outlet 134, thereby having a low flowrate. A negligible volume of fluid may also flow from the swirl chamber to the valve outlet through the other branches. In this manner, production of water and/or natural gas is minimized.

Figure 9A:
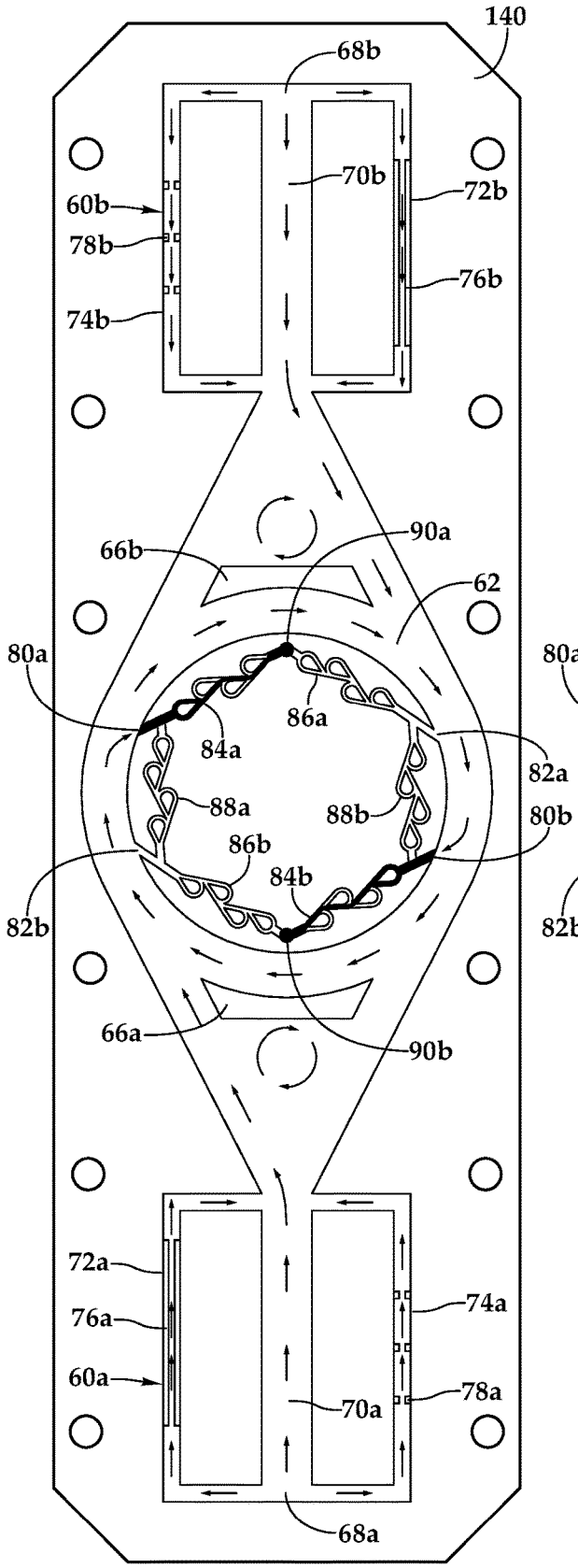
FIGS. 9A-9B are top views of an inner plate of an adaptive fluid switch according to embodiments of the present disclosure.
Figure 9B:
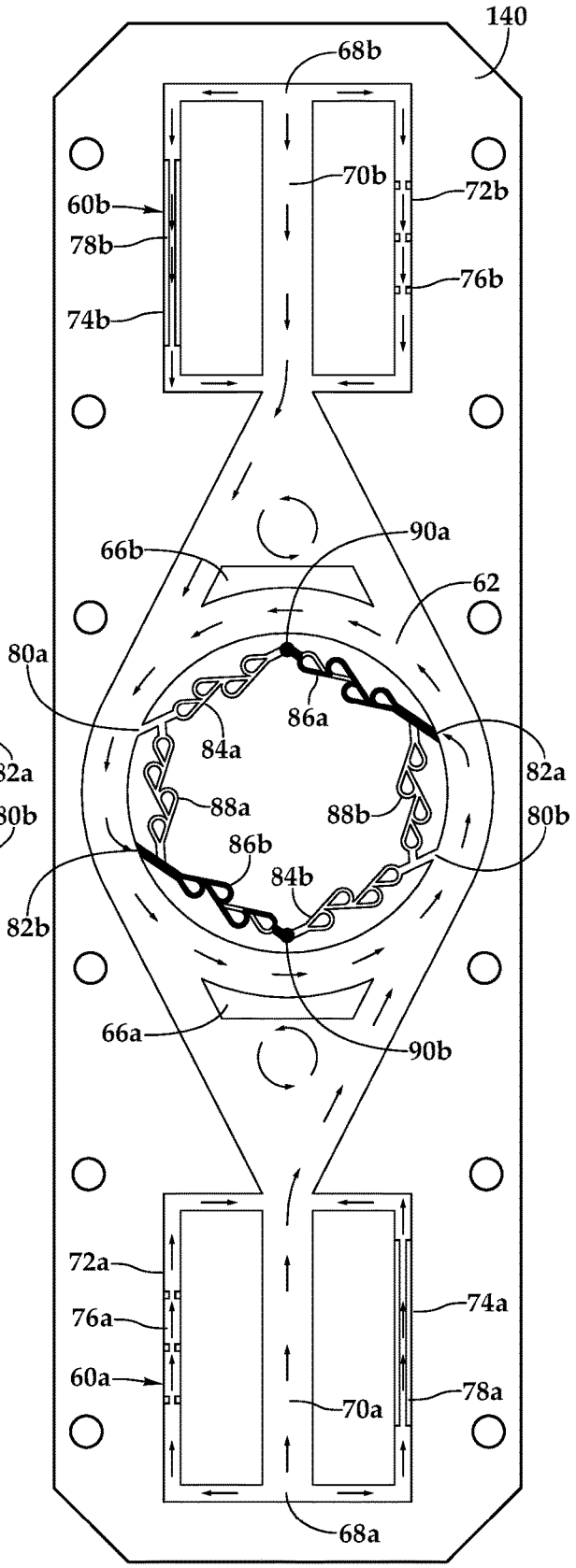

Even though the adaptive fluid switches of the present disclosure have been depicted and described as having a single inlet 58 (see FIG. 3) and a single fluid selector 60, it should be understood by those having ordinary skill in the art that an adaptive fluid switch of the present disclosure could have multiple inlets and multiple fluid selectors. For example, as best seen in FIGS. 9A-9B, an inner plate 140 includes two fluid selectors 60*a*, 60*b*. Fluid selector 60*a* includes inlet region 68*a*, main flow path 70*a*, viscosity dominated flow path 72*a* with resistor 76*a* and inertia dominated flow path 74*a* with resistor 78*a*. Disposed 180 degrees from fluid selector 60*a* is fluid selector 60*b* that includes inlet region 68*b*, main flow path 70*b*, viscosity dominated flow path 72*b* with resistor 76*b* and inertia dominated flow path 74*b* with resistor 78*b*. Inner plate 140 also includes two deflectors 66*a*, 66*b*. Swirl chamber 62 and self-impinging valve element 64 are substantially the same as those described herein with reference to FIGS. 4A-4D in structure and operation.

The operation of an adaptive fluid switch with inner plate 140 will now be described with two different fluids flowing therethrough. For the present example, resistors 76*a*, 76*b*, 78*a*, 78*b* have been tuned such that the first predetermined level is about 2 centipoises and the second predetermined level is about 1 centipoise. In FIG. 9A, the fluid flowing through the adaptive fluid switch represents oil having a viscosity between 10 and 100 centipoises. The fluid enters fluid selectors 60*a*, 60*b* at inlet regions 68*a*, 68*b* then flows through main flow paths 70*a*, 70*b*, viscosity dominated flow paths 72*a*, 72*b* and inertia dominated flow paths 74*a*, 74*b*. As the fluid has a viscosity greater than the first predetermined level, more fluid exits inertia dominated flow paths 74*a*, 74*b* than viscosity dominated flow paths 72*a*, 72*b* such that the fluid from main flow path 70*a* is urged to the left, directing the fluid toward the left side of swirl chamber 62 and fluid from main flow path 70*b* is urged to the right, directing the fluid toward the right side of swirl chamber 62. The fluid is now induced to swirl in the clockwise direction in swirl chamber 62 with portions of the fluid spiraling radially inwardly to enter valve element 64 at valve inlets 80*a*, 80*b* that are oriented to preferentially receive fluid that is swirling in the clockwise direction. The fluid then follows the low resistance flow paths (see FIG. 12A) through branches 84*a*, 84*b*, as indicated by the solid lines therein, to valve outlets 90*a*, 90*b*, thereby maintaining a high flowrate. A negligible volume of fluid may also flow from the swirl chamber to the valve outlets through the other branches. In this manner, production of oil is maximized.

In FIG. 9B, the fluid flowing through the adaptive fluid switch represents water or natural gas having a viscosity between 0.02 and 1 centipoise. The fluid enters fluid selectors 60*a*, 60*b* at inlet regions 68*a*, 68*b* then flows through main flow paths 70*a*, 70*b*, viscosity dominated flow paths 72*a*, 72*b* and inertia dominated flow paths 74*a*, 74*b*. As the fluid has a viscosity less than the second predetermined level, more fluid exits viscosity dominated flow paths 72*a*, 72*b* than inertia dominated flow paths 74*a*, 74*b* such that the fluid from main flow path 70*a* is urged to the right, directing the fluid toward the right side of swirl chamber 62 and fluid from main flow path 70*b* is urged to the left, directing the fluid toward the left side of swirl chamber 62. The fluid is now induced to swirl in the counter-clockwise direction in swirl chamber 62 with portions of the fluid spiraling radially inwardly to enter valve element 64 at valve inlets 82*a*, 82*b* that are oriented to preferentially receive fluid that is swirling in the counter-clockwise direction. The fluid then follows the high resistance flow paths (see FIG. 12B) through branches 86*a*, 86*b*, as indicated by the solid lines therein, to valve outlets 90*a*, 90*b*, thereby having a low flowrate. A negligible volume of fluid may also flow from the swirl chamber to the valve outlets through the other branches. In this manner, production of water and/or natural gas is minimized.

Figure 10A:
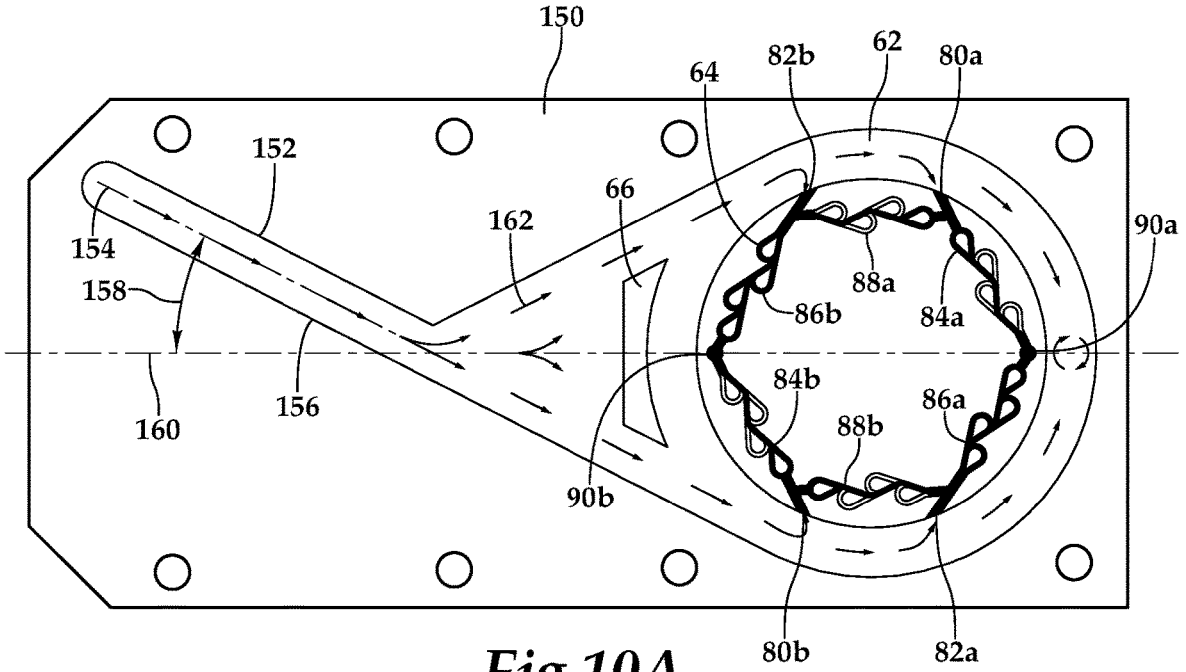
FIGS. 10A-10B are top views of an inner plate of an adaptive fluid switch according to embodiments of the present disclosure.
Figure 10B:
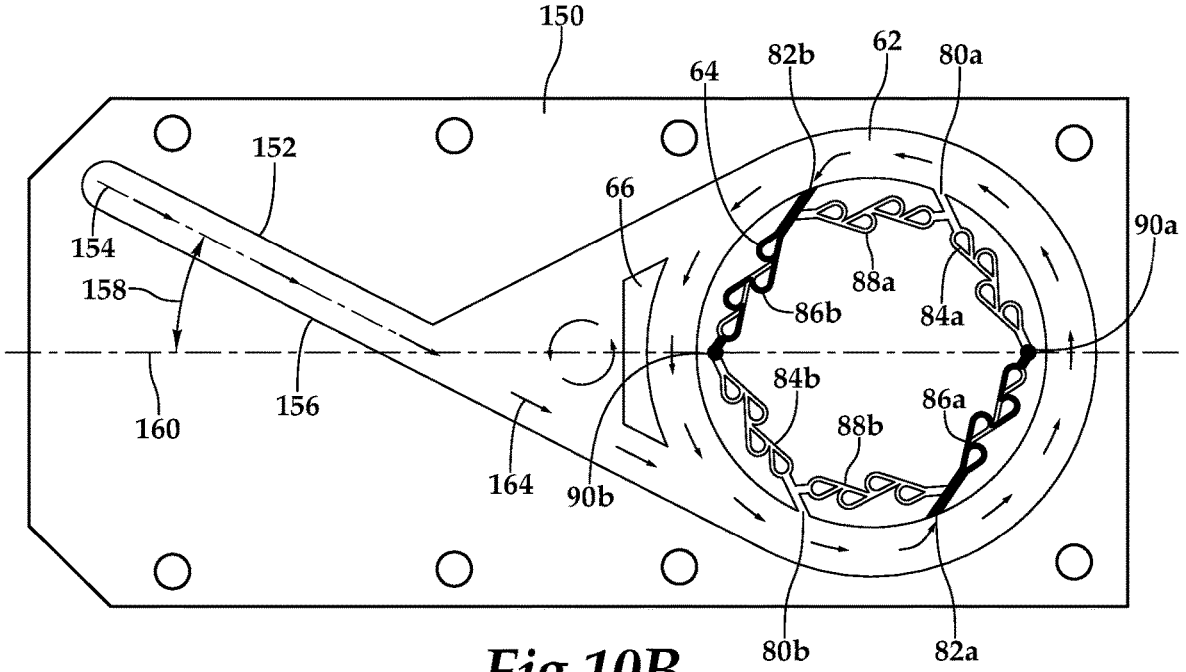

Even though a particular fluid selector 60 has been depicted and described herein for use in adaptive fluid switches of the present disclosure, it should be understood by those having ordinary skill in the art that an adaptive fluid switch of the present disclosure could use other types of fluid selectors to identify selected and non-selected fluids and to urge fluids to flow in a particular direction responsive thereto. For example, as best seen in FIGS. 10A-10B, an inner plate 150 of an adaptive fluid switch of the present disclosure includes a fluid selector 152 that includes an inlet region 154 and a main flow path 156 that is positioned at an angle 158 relative to a centerline 160 of inner plate 150. Inner plate 150 also includes swirl chamber 62, self-impinging valve element 64 and deflector 66 that are substantially the same as those described herein with reference to FIGS. 4A-4D in structure and operation. In the illustrated embodiment, angle 158 points main flow path 156 in line with the bottom of swirl chamber 62. In other embodiments, angle 158 could be greater than or less than the angle shown. In fact, changes in angle 158 are used to tune fluid selector 152. Based upon angle 158, fluid selector 152, swirl chamber 62, self-impinging valve element 64 and deflector 66 of inner plate 150 are configured to interpret the viscosity of a fluid flowing therethrough and to determine whether the fluid is a selected fluid, such as oil, or a non-selected fluid, such as natural gas or water.

Specifically, as best seen in FIG. 10A, inner plate 150 has a viscosity dominated flow path indicated collectively by arrows 162 when the fluid flowing therethrough has a viscosity greater than a first predetermined level, such as between 50 and 100 centipoises. As indicated by arrows 162, the viscosity dominated flow path includes fluid entering fluid selector 152 at inlet region 154, fluid flowing through main flow path 156, fluid diverging upon exiting main flow path 156, fluid entering swirl chamber 62 from both the top and the bottom without being induced to swirl and fluid entering each of valve inlets 80*a*, 80*b*, 82*a*, 82*b*. A portion of the fluid then follows the low resistance flow paths (see FIG. 12A) through branches 84*a*, 84*b*, as indicated by the solid lines therein, to valve outlets 90*a*, 90*b*. In addition, a portion of the fluid follows the high resistance flow paths (see FIG. 12B) through branches 86*a*, 86*b*, as indicated by the solid lines therein, to valve outlets 90*a*, 90*b*. A portion of the fluid also follows the low resistance flow paths (see FIG. 12A) through branches 88*a*, 88*b*, as indicated by the solid lines therein, from branch 86*a* to branch 84*b* and from branch 86*b* to branch 84*a* and eventually to valve outlets 90*a*, 90*b*. In this manner, production of the selected fluid, in the case oil, is maximized.

Likewise, as best seen in FIG. 10B, inner plate 150 has an inertia dominated flow path indicated collectively by arrows 164 when the fluid flowing therethrough has a viscosity less than a second predetermined level, such as between 5 and 10 centipoises. As indicated by arrows 164, the inertia dominated flow path includes fluid entering fluid selector 152 at inlet region 154, fluid flowing through main flow path 156, fluid being carried by moment toward the bottom of swirl chamber 62, fluid swirling in the counter-clockwise direction in swirl chamber 62, fluid spiraling radially inwardly to enter self-impinging valve element 64 at valve inlets 82*a*, 82*b* that are oriented to preferentially receive fluid that is swirling in the counter-clockwise direction, and fluid following the high resistance flow paths (see FIG. 12B) through branches 86*a*, 86*b*, as indicated by the solid lines therein, to valve outlets 90*a*, 90*b*, thereby having a low flowrate. A negligible volume of fluid may also flow from the swirl chamber to the valve outlets through the other branches. In this manner, production of the non-selected fluid, in this case natural gas and/or water, is minimized.

Figure 11A:
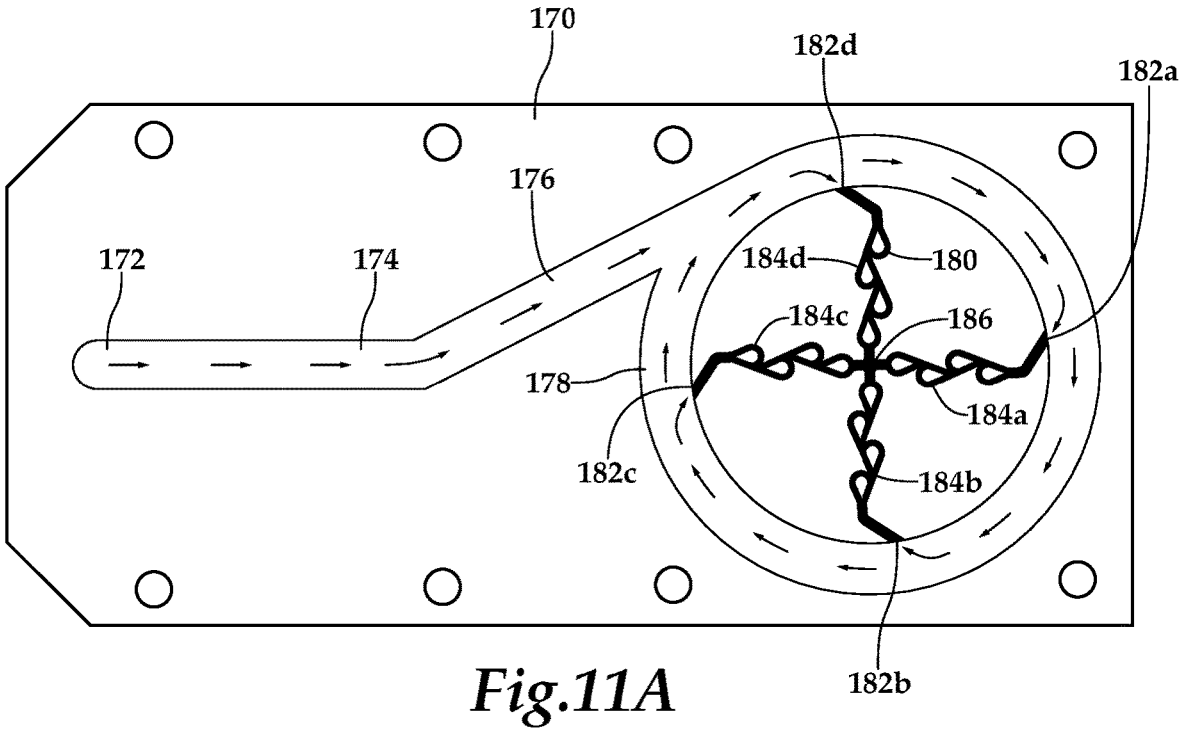
FIGS. 11A-11B are top views of an inner plate of an adaptive fluid switch according to embodiments of the present disclosure.
Figure 11B:
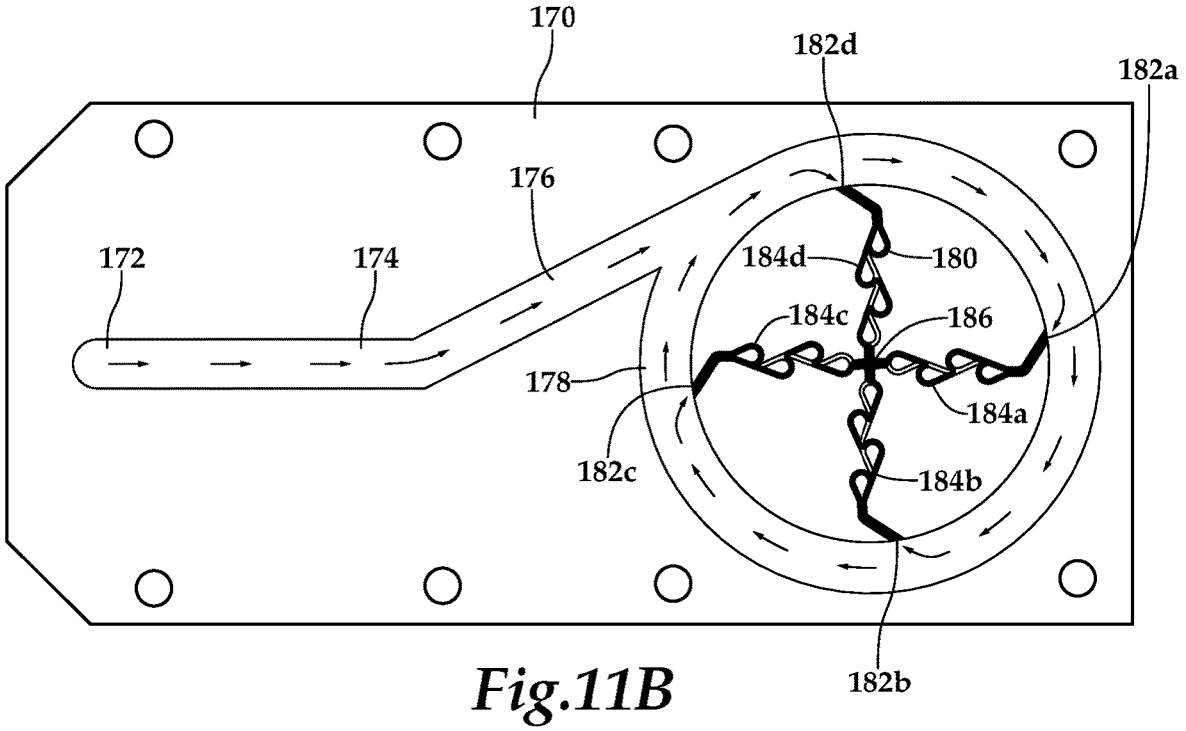

In another example, as best seen in FIGS. 11A-11B, the fluid selection functionality may take place within the self-impinging valve element of an inner plate 170 of an adaptive fluid switch of the present disclosure. Inner plate 170 includes an inlet region 172 and a main flow path 174 with an angled portion 176 that directs fluid to the top of a swirl chamber 178 where the fluid is induced to swirl in the clockwise direction. Inner plate 170 includes a valve element depicted as a multistage self-impinging cross valve element 180 having multiple valve inlets 182*a*, 182*b*, 182*c*, 182*d* that are oriented to preferentially receive fluid that is swirling in the clockwise direction. Valve element 180 has a plurality of parallel branches 184*a*, 184*b*, 184*c*, 184*d* respectively coupled to valve inlets 182*a*, 182*b*, 182*c*, 182*d*, which may be collectively referred to as branches 184. Valve element 180 has a single valve outlet 186 that would be aligned with and in fluid communication with a discharge port of base pipe 32. Based upon the design of branches 184, an adaptive fluid switch including inner plate 170 is configured to interpret the viscosity of a fluid flowing therethrough and to determine whether the fluid is a selected fluid, such as oil, or a non-selected fluid, such as natural gas or water.

Figure 13A:
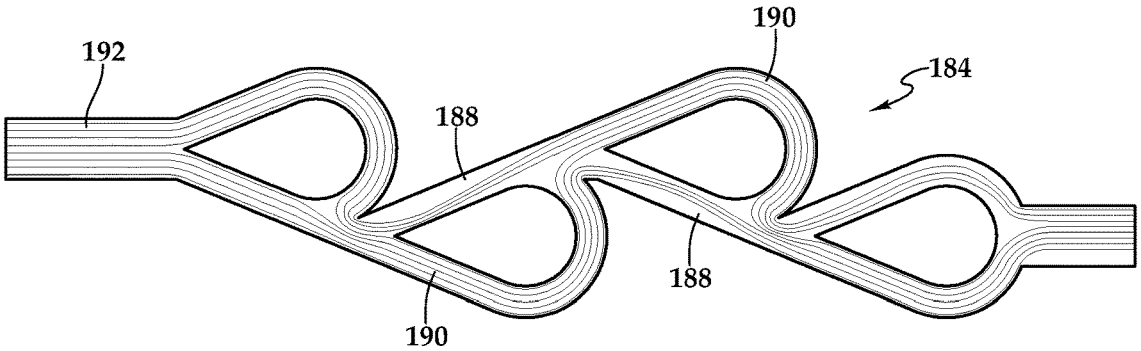
FIGS. 13A-13D are flow diagrams depicting fluid traveling through a fluid conduit of a multistage self-impinging valve element for use in an adaptive fluid switch according to embodiments of the present disclosure.
Figure 13B:
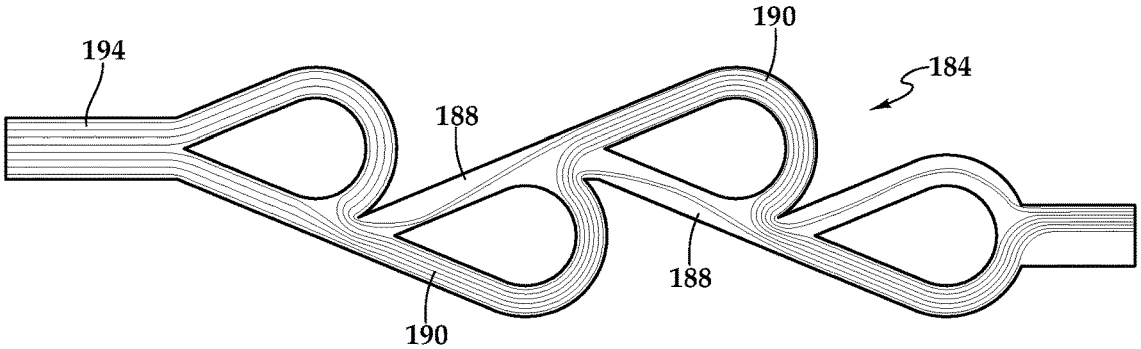

Specifically, as best seen in FIG. 11A, inner plate 170 has a viscosity dominated flow path when the fluid flowing therethrough has a viscosity greater than a first predetermined level, such as between 5 and 10 centipoises. As indicated by the solid lines filling branches 184, the viscosity dominated flow path includes both the compliant flow paths 188 and the impinging flow paths 190 within the tesla valve conduits of branches 184, as best seen in FIGS. 13A-13D. For example, FIG. 13A depicts a selected fluid in the form of oil having a viscosity in the range of 50 centipoises flowing from left to right in the impinging direction as indicated by streamlines 192. In the illustrated embodiment, after the first tesla loop, approximately sixty percent of the fluid flows in impinging flow paths 190 with approximately forty percent of the fluid flowing in compliant flow paths 188. Thus, in the case of medium oil flowing through valve element 180, nearly the entire cross section of the tesla valve conduit is utilized along the entire length of the tesla valve conduit allowing the fluid to flow at a relative high flowrate. As another example, FIG. 13B depicts a selected fluid in the form of oil having a viscosity in the range of 10 centipoises flowing from left to right in the impinging direction as indicated by streamlines 194. In the illustrated embodiment, after the first tesla loop, approximately seventy-five percent of the fluid flows in impinging flow paths 190 with approximately twenty-five percent of the fluid flowing in compliant flow paths 188. Thus, in the case of light oil flowing through valve element 180, a majority of the cross section of the tesla valve conduit is utilized along the entire length of the tesla valve conduit allowing the fluid to flow at a relative high flowrate. In this manner, production of the selected fluid, in the case light oil, is maximized.

Figure 13C:
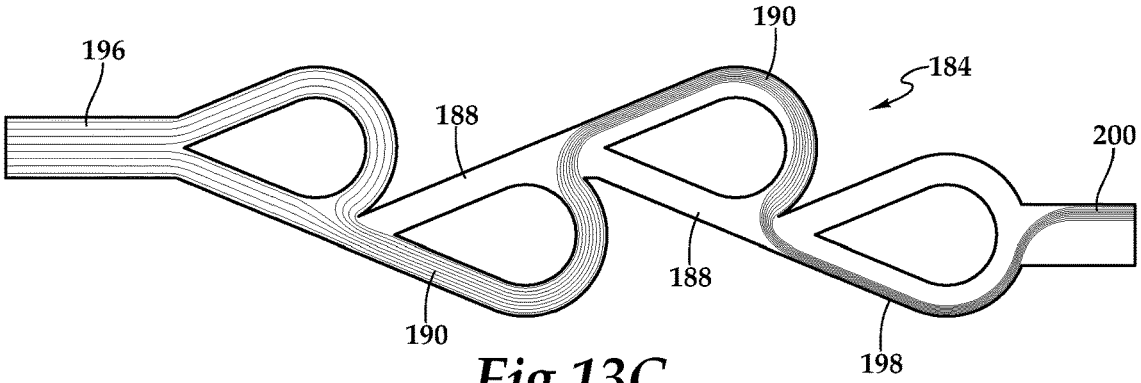

As best seen in FIG. 11B, inner plate 170 has an inertia dominated flow path when the fluid flowing therethrough has a viscosity less than a second predetermined level, such as between 1 and 5 centipoises. As indicated by the solid lines only partially filing branches 184, the inertia dominated flow path includes impinging flow paths 190 while excluding compliant flow paths 188 of the tesla valve conduit. For example, FIG. 13C depicts a non-selected fluid in the form of water having a viscosity in the range of 0.50 centipoises flowing from left to right in the impinging direction as indicated by streamlines 196. In the illustrated embodiment, after the first tesla loop, all or nearly all of the fluid flows in impinging flow paths 190 with none or nearly none of the fluid flowing in compliant flow paths 188. Thus, in the case of water flowing through valve element 180, significant portions of the cross section of the tesla valve conduit are not utilized. This flow interference or choking is further exemplified in the last tesla loop at location 198 and the discharge tube at location 200 in which the fluid uses only a fraction of the available cross section of the tesla valve conduit, thereby resulting in a significantly reduced flowrate. In this manner, production of the non-selected fluid, in this case water, is minimized.

Figure 13D:
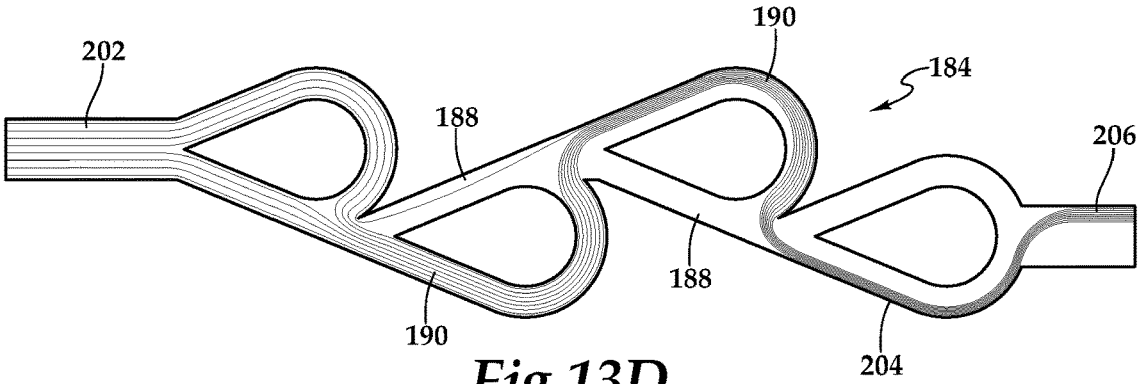

As another example, FIG. 13D depicts a non-selected fluid in the form of natural gas having a viscosity in the range of 0.02 centipoises flowing from left to right in the impinging direction as indicated by streamlines 202. In the illustrated embodiment, after the first tesla loop, all or nearly all of the fluid flows in impinging flow paths 190 with none or nearly none of the fluid flowing in compliant flow paths 188. Thus, in the case of natural gas flowing through valve element 180, significant portions of the cross section of the tesla valve conduit are not utilized. This flow interference or choking is further exemplified in the last tesla loop at location 204 and the discharge tube at location 206 in which the fluid uses only a fraction of the available cross section of the tesla valve conduit, thereby resulting in a significantly reduced flowrate. In this manner, production of the non-selected fluid, in this case natural gas, is minimized.

Even though valve element 180 has been depicted and described as having four parallel branches 184*a*, 184*b*, 184*c*, 184*d*, it should be understood by those having ordinary skill in the art that a valve element for an adaptive fluid switch of the present disclosure that has fluid selection functionality could have other configurations including valve elements having other numbers of branches both greater than and less than four including having a single branch. Also, even though valve element 180 has been depicted and described as having four valve inlets 182*a*, 182*b*, 182*c*, 182*d* and a single valve outlet 186, it should be understood by those having ordinary skill in the art that a valve element for an adaptive fluid switch of the present disclosure that has fluid selection functionality could have other configurations including valve elements having other numbers of valve inlets both greater than and less than four including having a single valve inlet and/or other numbers of valve outlets that are greater than one.

Figure 14A:
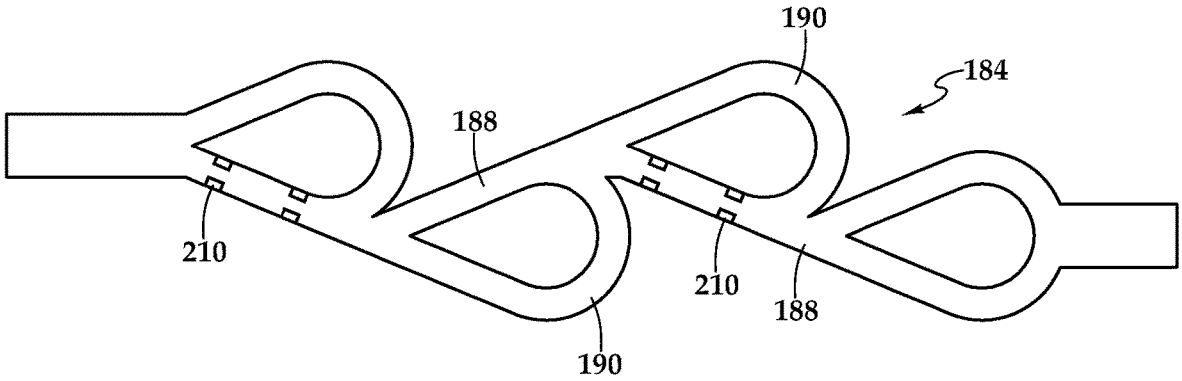
FIGS. 14A-14C are schematic illustrations of various fluid conduits for use in a multistage self-impinging valve element of an adaptive fluid switch according to embodiments of the present disclosure.
Figure 14B:
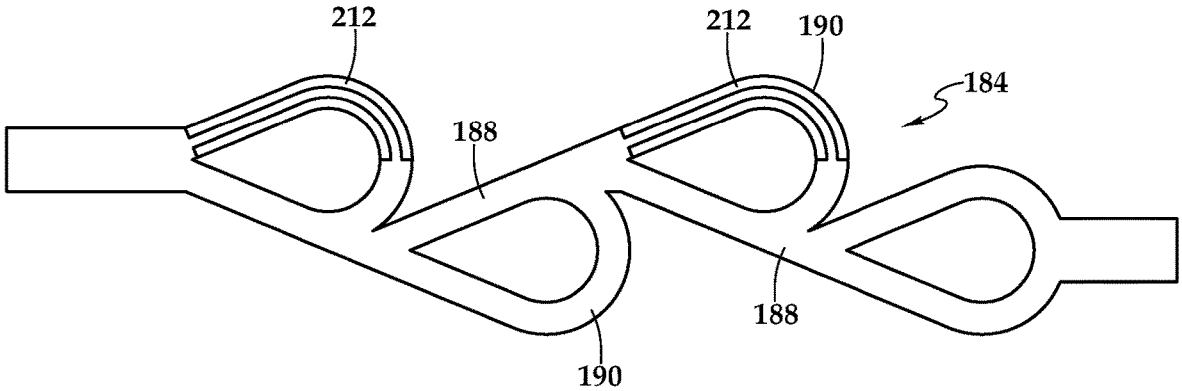
Figure 14C:
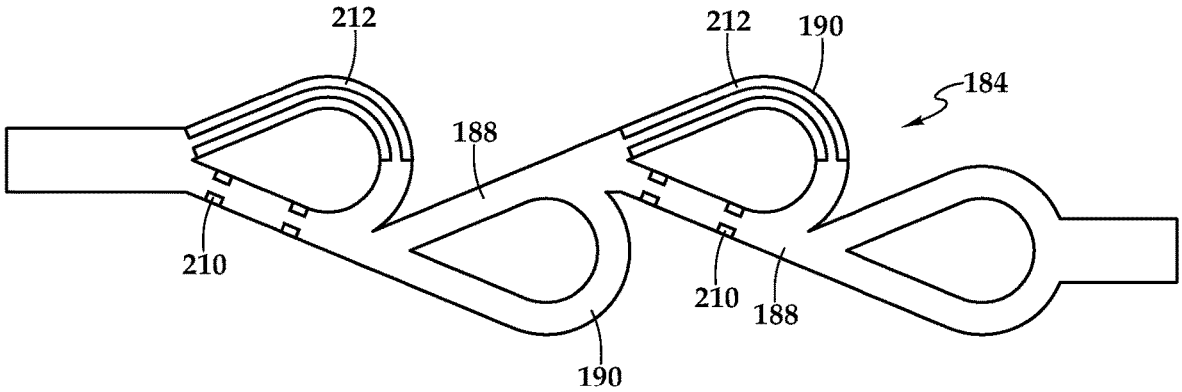

The fluid selection functionality of a tesla valve conduit can be tuned to adjust the first and second predetermined levels depending upon the desired viscosity sensitivity. For example, as best seen in FIG. 14A, one or more inertia dependent resistors 210, such as orifices, may be located in tesla valve conduit 184 in compliant flow paths 188 to preferentially allow higher viscosity fluid and preferentially impede lower viscosity fluid from flowing therethrough. As another example, as best seen in FIG. 14B, one or more viscosity dependent resistors 212, such as flow tubes, may be located in tesla valve conduit 184 in impinging flow paths 190 to preferentially allow lower viscosity fluid and preferentially impede higher viscosity fluid from flowing therethrough. In an additional example, as best seen in FIG. 14C, one or more inertia dependent resistors 210, such as orifices, may be located in tesla valve conduit 184 in compliant flow paths 188 to preferentially allow higher viscosity fluid and preferentially impede lower viscosity fluid from flowing therethrough and one or more viscosity dependent resistors 212, such as flow tubes, may be located in tesla valve conduit 184 in impinging flow paths 190 to preferentially allow lower viscosity fluid and preferentially impede higher viscosity fluid from flowing therethrough.

Figure 15A:
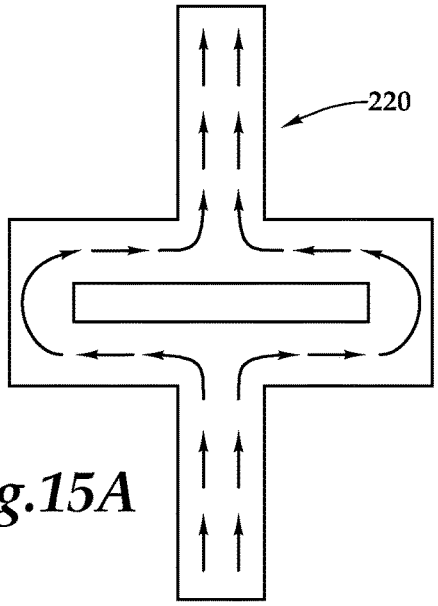
FIGS. 15A-15B are schematic illustrations of a self-impinging flow element for use in a self-impinging valve element according to embodiments of the present disclosure.
Figure 15B:
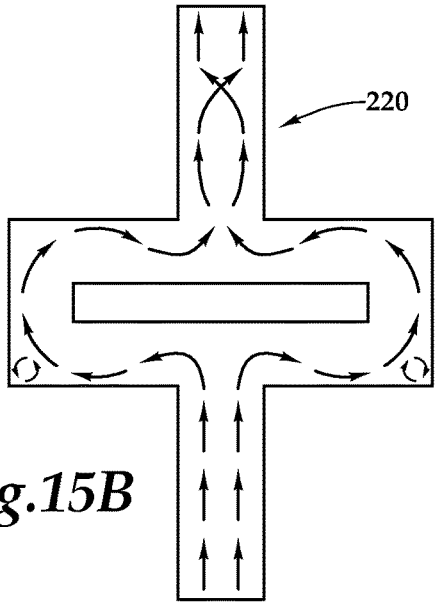
Figure 16A:
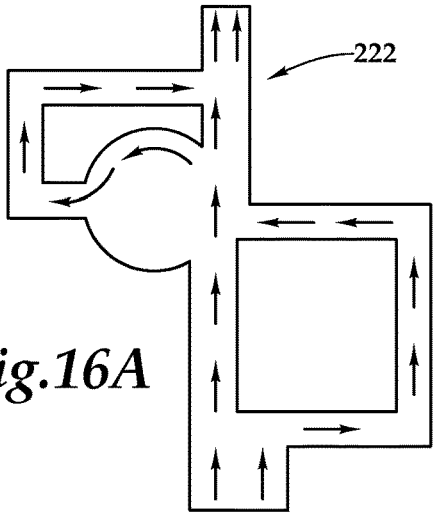
FIGS. 16A-16B are schematic illustrations of a self-impinging flow element for use in a self-impinging valve element according to embodiments of the present disclosure.
Figure 16B:
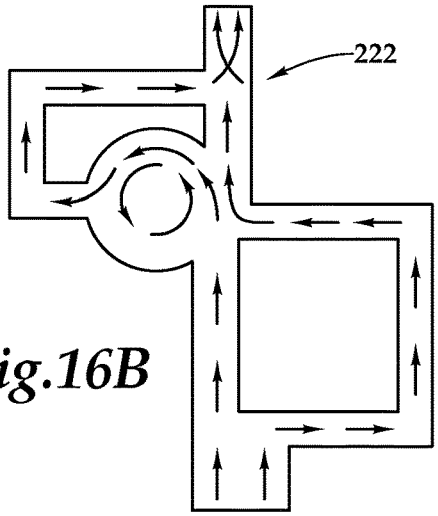
Figure 17A:
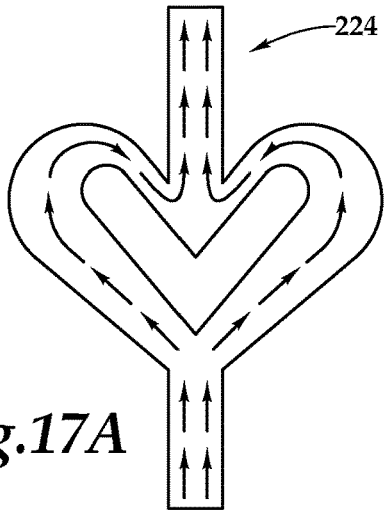
FIGS. 17A-17B are schematic illustrations of a self-impinging flow element for use in a self-impinging valve element according to embodiments of the present disclosure.
Figure 17B:
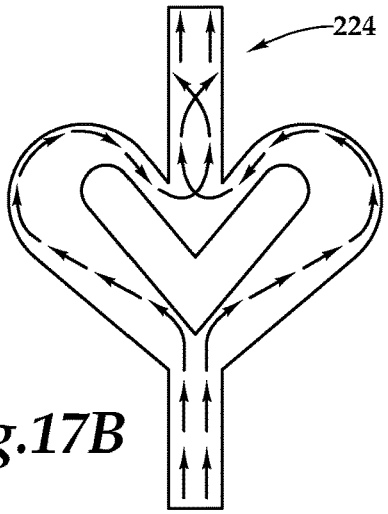

Even though the self-impinging valve elements having fluid selection functionality have been depicted and described as including tesla valve conduits, it should be understood by those having ordinary skill in the art that a valve element for an adaptive fluid switch of the present disclosure could use other types of self-impinging elements with fluid selection functionality. For example, FIGS. 15A-15B depict a self-impinging element 220 in the form of a flow passageway with a transverse barrier. As best seen by a comparison of FIGS. 15A-15B, a high viscosity fluid flows around the barrier with minimal losses (see FIG. 15A) while a low viscosity fluid engages in swirling flow and mixing flow generating significant losses (see FIG. 15B). As another example, FIGS. 16A-16B depict a self-impinging element 222 in the form of a flow passageway having return flow and swirling flow paths. As best seen by a comparison of FIGS. 16A-16B, a high viscosity fluid flows through the complex structure with minimal losses (see FIG. 16A) while a low viscosity fluid engages in swirling flow, mixing flow and cross flow generating significant losses (see FIG. 16B). In an additional example, FIGS. 17A-17B depict a self-impinging element 224 in the form of a flow passageway having reverse flow paths. As best seen by a comparison of FIGS. 17A-17B, a high viscosity fluid flows through the complex structure with minimal losses (see FIG. 17A) while a low viscosity fluid engages in mixing flow and cross flow generating significant losses (see FIG. 17B).

The foregoing description of embodiments of the disclosure has been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated. Other substitutions, modifications, changes and omissions may be made in the design, operating conditions and arrangement of the embodiments without departing from the scope of the present disclosure. Such modifications and combinations of the illustrative embodiments as well as other embodiments will be apparent to persons skilled in the art upon reference to the description. It is, therefore, intended that the appended claims encompass any such modifications or embodiments.

What is claimed is:

1. An adaptive fluid switch for regulating a production rate of a fluid having a viscosity, the adaptive fluid switch comprising:

a fluid control module configured to interpret the viscosity of the fluid and determine whether the fluid is a selected fluid or a non-selected fluid; and a self-impinging valve element disposed within the fluid control module, the valve element having a viscosity dominated flow path configured to provide a first flow resistance and an inertia dominated flow path configured to provide a second flow resistance that is greater than the first flow resistance;

wherein, when the viscosity of the fluid is greater than a first predetermined level, the fluid control module interprets the fluid to be the selected fluid such that the fluid follows the viscosity dominated flow path with the first flow resistance, the viscosity dominated flow path being a high flowrate path; and wherein, when the viscosity of the fluid is less than a second predetermined level, the fluid control module interprets the fluid to be the non-selected fluid such that the fluid follows the inertia dominated flow path with the second flow resistance, the inertia dominated flow path being a low flowrate path, thereby regulating the production rate of the fluid responsive to changes in the viscosity of the fluid.

2. The adaptive fluid switch as recited in claim 1 wherein the fluid further comprises a multiphase fluid containing at least an oil component and a water component;

wherein the selected fluid has a predetermined amount of the oil component; and wherein the non-selected fluid has a predetermined amount of the water component.

3. The adaptive fluid switch as recited in claim 1 wherein the fluid further comprises a multiphase fluid containing at least an oil component and a natural gas component;

wherein the selected fluid has a predetermined amount of the oil component; and wherein the non-selected fluid has a predetermined amount of the natural gas component.

4. The adaptive fluid switch as recited in claim 1 wherein the fluid control module is configured to interpret the viscosity of the fluid as an effective viscosity of a single phase fluid.

5. The adaptive fluid switch as recited in claim 1 wherein the first predetermined level is between 1 centipoise and 10 centipoises; and wherein the second predetermined level is between 0.1 centipoises and 1 centipoise.

6. The adaptive fluid switch as recited in claim 1 wherein the first predetermined level has a ratio to the second predetermined level of between 2 to 1 and 10 to 1.

7. The adaptive fluid switch as recited in claim 1 wherein the valve element further comprises a multistage self-impinging valve element.

8. The adaptive fluid switch as recited in claim 1 wherein the valve element further comprises a multistage self-impinging valve element having a plurality of parallel branches.

9. The adaptive fluid switch as recited in claim 1 wherein the valve element further comprises a ring valve element having multiple inlets and multiple outlets.

10. The adaptive fluid switch as recited in claim 1 wherein the valve element further comprises a tesla ring valve element.

11. The adaptive fluid switch as recited in claim 1 wherein the valve element further comprises a bow valve element.

12. The adaptive fluid switch as recited in claim 1 wherein the valve element further comprises a cross valve element.

13. The adaptive fluid switch as recited in claim 1 further comprising a swirl chamber disposed within the fluid control module, the swirl chamber configured to induce the selected fluid to swirl in a first direction and induce the non-selected fluid to swirl in a second direction that is opposite of the first direction.

14. The adaptive fluid switch as recited in claim 1 wherein the valve element further comprises at least one impinging flow path and at least one compliant flow path.

15. The adaptive fluid switch as recited in claim 14 further comprising at least one viscosity dependent resistor disposed within the impinging flow path.

16. The adaptive fluid switch as recited in claim 14 further comprising at least one inertia dependent resistor disposed within the compliant flow path.

17. The adaptive fluid switch as recited in claim 14 further comprising at least one viscosity dependent resistor disposed within the impinging flow path and at least one inertia dependent resistor disposed within the compliant flow path.

18. An adaptive fluid switch for regulating a production rate of a fluid having a viscosity, the adaptive fluid switch comprising:

a fluid control module having at least one inlet and at least one outlet;

a fluid selector disposed within the fluid control module, the fluid selector configured to interpret the viscosity of the fluid and determine whether the fluid is a selected fluid or a non-selected fluid;

a swirl chamber disposed within the fluid control module downstream of the fluid selector, the swirl chamber configured to induce the selected fluid to swirl in a first direction and induce the non-selected fluid to swirl in a second direction that is opposite of the first direction; and a self-impinging valve element disposed within the fluid control module, the valve element having multiple valve inlets, at least one valve outlet and a plurality of parallel branches, the valve inlets in fluid communication with the swirl chamber, the at least one valve outlet in fluid communication with the at least one outlet of the fluid control module, the valve element having a viscosity dominated flow path configured to provide a first flow resistance and an inertia dominated flow path configured to provide a second flow resistance that is greater than the first flow resistance;

wherein, when the viscosity of the fluid is greater than a first predetermined level, the fluid selector determines the fluid to be the selected fluid such that the fluid swirls in the first direction in the swirl chamber and follows the viscosity dominated flow path in the valve element, the viscosity dominated flow path being a high flowrate path; and wherein, when the viscosity of the fluid is less than a second predetermined level, the fluid selector determines the fluid to be the non-selected fluid such that the fluid swirls in the second direction in the swirl chamber and follows the inertia dominated flow path in the valve element, the inertia dominated flow path being a low flowrate path, thereby regulating the production rate of the fluid responsive to changes in the viscosity of the fluid.

19. The adaptive fluid switch as recited in claim 18 wherein the valve element is selected from the group consisting of a multistage self-impinging valve element, a ring valve element, a tesla ring valve element, a bow valve element or a cross valve element.

* * * * *